US009734650B2

(12) United States Patent
Togiya et al.

(10) Patent No.: US 9,734,650 B2
(45) Date of Patent: Aug. 15, 2017

(54) MEDIUM PROCESSING DEVICE

(71) Applicant: Oki Electric Industry Co., Ltd., Tokyo (JP)

(72) Inventors: Hajime Togiya, Tokyo (JP); Takamoto Yokote, Tokyo (JP); Satoru Iwasaki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 158 days.

(21) Appl. No.: 14/761,940

(22) PCT Filed: Dec. 5, 2013

(86) PCT No.: PCT/JP2013/082739
§ 371 (c)(1),
(2) Date: Jul. 17, 2015

(87) PCT Pub. No.: WO2014/125704
PCT Pub. Date: Aug. 21, 2014

(65) Prior Publication Data

US 2015/0356808 A1 Dec. 10, 2015

(30) Foreign Application Priority Data

Feb. 14, 2013 (JP) ..... 2013-026429

(51) Int. Cl.
*G07D 11/00* (2006.01)
*B65H 5/26* (2006.01)
(Continued)

(52) U.S. Cl.
CPC ..... *G07D 11/0084* (2013.01); *B65H 5/26* (2013.01); *B65H 7/20* (2013.01); *B65H 33/00* (2013.01);
(Continued)

(58) Field of Classification Search
CPC ..... G07D 7/0033; G07D 11/0051; G07D 11/006; G07D 11/0072; G07D 11/0084;
(Continued)

(56) References Cited

U.S. PATENT DOCUMENTS 4,473,157 A * 9/1984 Hirose ..... G07D 11/0081 209/534

FOREIGN PATENT DOCUMENTS

CN 101359417 A 2/2009
CN 101533537 A 9/2009
(Continued)

*Primary Examiner* — Mark Beauchaine
(74) *Attorney, Agent, or Firm* — Rabin & Berdo, P.C.

(57) ABSTRACT

A banknote deposit and withdrawal apparatus causes a control section to function as an inserted medium counting unit, a normal medium counting unit and an abnormal mediums number calculation unit. The normal medium counting unit again feeds out and conveys banknotes from the banknote deposit and withdrawal section to the verification section in a quantity corresponding to the number of inserted banknotes, conveys abnormal banknotes that are verified as abnormal by the verification section to the banknote deposit and withdrawal section together with following banknotes but conveys normal banknotes that are verified as normal by the verification section to the temporary holding section and retains the normal banknotes therein, and counts a number of normal banknotes. The abnormal mediums number calculation unit subtracts the number of normal banknotes from the number of inserted banknotes to calculate an abnormal banknotes number.

10 Claims, 19 Drawing Sheets

(51) Int. Cl.

| | |
|---|---|
| ***B65H 7/20*** | (2006.01) |
| ***B65H 39/04*** | (2006.01) |
| ***B65H 39/06*** | (2006.01) |
| ***B65H 43/04*** | (2006.01) |
| ***B65H 43/06*** | (2006.01) |
| ***B65H 33/00*** | (2006.01) |
| ***G07F 19/00*** | (2006.01) |
| ***G07D 7/00*** | (2016.01) |
| ***B65H 85/00*** | (2006.01) |
| ***B65H 83/00*** | (2006.01) |

(52) U.S. Cl.
CPC ..... *B65H 39/04* (2013.01); *B65H 39/06* (2013.01); *B65H 43/04* (2013.01); *B65H 43/06* (2013.01); *B65H 83/00* (2013.01); *B65H 85/00* (2013.01); *G07D 7/0033* (2013.01); *G07F 19/202* (2013.01); *B65H 2511/30* (2013.01)

(58) Field of Classification Search
CPC ..... G07F 19/20; G07F 19/202; B65H 5/26; B65H 7/20; B65H 39/04; B65H 43/06; B65H 33/00
See application file for complete search history.

(56) References Cited

FOREIGN PATENT DOCUMENTS

| | | | |
|---|---|---|---|
| CN | 101763683 | A | 6/2010 |
| JP | H01-217692 | A | 8/1989 |
| JP | 2010-152722 | A | 7/2010 |
| JP | 2012-084065 | A | 4/2012 |

* cited by examiner

MEDIUM PROCESSING DEVICE

TECHNICAL FIELD

The present invention relates to a medium processing device, and is excellently applied to, for example, an automatic teller machine (ATM) or the like in which mediums such as banknotes or the like are inserted and desired transactions are carried out.

BACKGROUND ART

Heretofore, in accordance with details of a transaction with a customer, an ATM or the like that is used in a financial institution, a store or the like allows the customer to, for example, deposit cash, such as banknotes and coins or the like, or to withdraw cash.

Among ATMs there is, for example, an ATM that includes: a banknote deposit and withdrawal section for transferring banknotes to and from customers; a verification section that verifies the denominations of deposited banknotes and whether the banknotes are authentic or counterfeit; a temporary holding section that temporarily retains inserted banknotes; a conveyance section that conveys the banknotes; and banknote cassettes that store the banknotes of the respective denominations.

In an ATM, it has been proposed (for example, see Japanese Patent Application Laid-Open (JP-A) No. 2010-152722) to retain normal banknotes that have been determined to be normal by a verification section in a temporary holding section but stack abnormal banknotes that are determined to be abnormal in a banknote deposit and withdrawal section, in which there is no physical divider between the abnormal banknotes and inserted banknotes.

DISCLOSURE OF INVENTION

Technical Problem

In this ATM, because the abnormal banknotes are stacked in the banknote deposit and withdrawal section in which inserted banknotes and abnormal banknotes are not physically separated, there is a risk that it may not be possible to accurately identify a number of abnormal banknotes when banknotes are returned to a user.

The present invention has been made in consideration of the problem described above and proposes a medium processing device that may improve a degree of certainty of numbers of abnormal banknotes.

Solution to Problem

In order to solve this problem, a medium processing device of the present invention is provided with: a medium accommodation section that separates an accommodated plurality of paper-form mediums one at a time and feeds out the mediums to a conveyance section, and that stacks the mediums that are conveyed from the conveyance section; a verification section that is provided on the conveyance path and verifies whether the mediums are normal or abnormal; a medium retention section that is provided on the conveyance path and temporarily retains the mediums; an inserted medium counting unit that feeds out all of the mediums from the medium accommodation section, counts an inserted mediums number, which is a total number of the mediums, and conveys the mediums to the medium accommodation section; a normal medium counting unit that again feeds out the mediums from the medium accommodation section and conveys the mediums to the verification section, conveys normal mediums that are verified as being normal by the verification section to the medium retention section and retains the mediums thereat, and counts a normal mediums number, which is a total number of the normal mediums; and an abnormal mediums number calculation unit that subtracts the normal mediums number from the inserted mediums number and calculates an abnormal mediums number, which is a number of the abnormal mediums.

In this medium processing device, a number of abnormal banknotes in a verification operation of mediums may be accurately calculated after the verification operation, just by the simple operation of counting a number of inserted mediums before the verification operation.

A further medium processing device of the present invention is provided with: a medium accommodation section that separates an accommodated plurality of paper-form mediums one at a time and feeds out the mediums to a conveyance section, and that stacks the mediums that are conveyed from the conveyance section; a verification section that is provided on the conveyance path and verifies whether the mediums are normal or abnormal; a medium retention section that is provided on the conveyance path and temporarily retains the mediums; a medium division and conveyance unit that feeds out all of the mediums from the medium accommodation section and conveys the mediums to the verification section, and conveys abnormal mediums that are verified as being abnormal at the verification section to the medium accommodation section; and an abnormal medium counting unit that feeds out all of the abnormal mediums from the medium accommodation section, counts an abnormal mediums number, which is a total number of the abnormal mediums, and conveys the abnormal mediums to the medium accommodation section.

This medium processing device may accurately calculate a number of abnormal mediums in a short duration.

A still further medium processing device of the present invention is provided with: a medium accommodation section that separates an accommodated plurality of paper-form mediums one at a time and feeds out the mediums to a conveyance section, and that stacks the mediums that are conveyed from the conveyance section; a verification section that is provided on the conveyance path and verifies whether the mediums are normal or abnormal; a medium retention section that is provided on the conveyance path and temporarily retains the mediums; a normal medium removal and conveyance unit that feeds out the mediums from the medium accommodation section and conveys the mediums to the verification section, conveys normal mediums that are verified as being normal by the verification section to the medium retention section and retains the normal mediums thereat, and conveys a medium that is verified as being abnormal at the verification section to the medium accommodation section and pauses the feeding of the mediums from the medium accommodation section; a fed-out medium counting unit that feeds out all of the mediums, from which the normal mediums have been removed by the normal medium removal and conveyance unit, from the medium accommodation section, counts a fed-out mediums number, which is a total number of the mediums fed out from the medium accommodation section, and conveys the mediums to the medium retention section; a normal medium counting unit that again feeds out the mediums from the medium accommodation section in a quantity corresponding to the fed-out mediums number and conveys the mediums to the verification section, conveys normal mediums that are verified as being normal by the verification section to the medium retention section and retains the normal mediums thereat, and counts a normal mediums number, which is a total number of the normal mediums; and an abnormal mediums number calculation unit that subtracts the normal mediums number from the fed-out mediums number and calculates an abnormal mediums number, which is a number of the abnormal mediums.

This medium processing device may shorten a duration of counting of a number of fed-out mediums before a verification operation of the mediums, and may accurately calculate a number of abnormal mediums in a short duration.

A yet further medium processing device of the present invention is provided with: a medium accommodation section that separates an accommodated plurality of paper-form mediums one at a time and feeds out the mediums to a conveyance section, and that stacks the mediums that are conveyed from the conveyance section; a verification section that is provided on the conveyance path and verifies whether the mediums are normal or abnormal; a medium retention section that is provided on the conveyance path and temporarily retains the mediums; a medium division and conveyance unit that feeds out all of the mediums from the medium accommodation section and conveys the mediums to the verification section, and conveys abnormal mediums that are verified as being abnormal at the verification section to the medium accommodation section; a serial number reading unit that feeds out the abnormal mediums from the medium accommodation section, reads serial numbers of the abnormal mediums, and conveys the abnormal mediums to the medium accommodation section; a serial number memorization unit that memorizes the serial numbers read by the serial number reading unit; and an abnormal medium counting unit that counts a number of the abnormal mediums fed out from the medium accommodation section, until a serial number that is the same as a serial number that has been memorized in the serial number memorization unit is read by the serial number reading unit.

This medium processing device may accurately calculate a number of abnormal mediums just by performing verification operations and performing the simple operation of counting the number of abnormal banknotes until a matching serial number is detected.

Advantageous Effects of Invention

According to the present invention, a number of abnormal mediums may be accurately identified. Thus, the present invention may realize a medium processing device that may improve a degree of certainty in the number of abnormal mediums.

BEST MODE FOR CARRYING OUT THE INVENTION

Herebelow, modes for carrying out the invention (referred to as embodiments hereinafter) are described using the attached drawings.

1. First Embodiment

—1-1. Structure of ATM—

Figure 1:
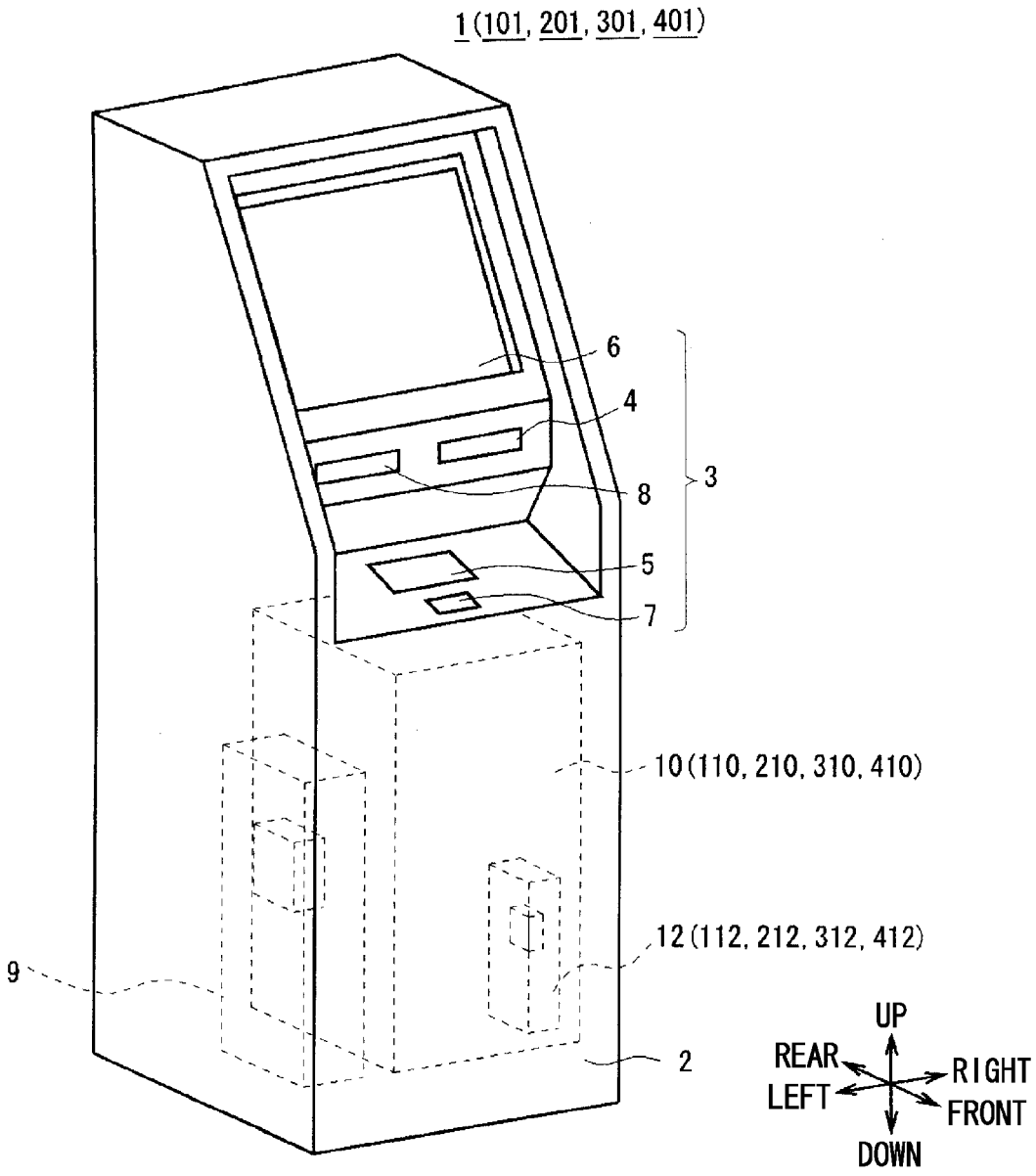
FIG. 1 is a perspective diagram showing structures of an ATM.

As shown by the exterior in FIG. 1, an ATM 1 is basically structured by a box-shaped casing 2. The ATM 1 is disposed in, for example, a financial institution or the like, and conducts transactions relating to cash with customers, such as deposit transactions, withdrawal transactions and the like.

The casing 2 has a shape in which a front side thereof is recessed at an angle at a location at which a customer standing in front of the casing 2 may easily insert banknotes, operate the ATM 1 through a touchscreen and the like; that is, this location is a region extending from an upper portion of the front face of the casing 2 to an upper face of the casing 2. A customer service section 3 is provided at this region.

The customer service section 3 includes a card insertion and ejection aperture 4, a deposit and withdrawal aperture 5, an operation and display unit 6, a ten-key pad 7 and a receipt issue aperture 8. The customer service section 3 directly gives and receives cash, bank books and the like to and from customers, and gives information about transactions and receives operational instructions.

The card insertion and ejection aperture 4 is a region at which various cards such as cash cards and the like are inserted and ejected. A card processing section (not shown in the drawings) is disposed behind the card insertion and ejection aperture 4. The card processing section reads account numbers that are magnetically recorded on the various cards, and the like.

The banknote deposit and withdrawal aperture 5 is a region at which customers insert banknotes to be deposited and at which banknotes being withdrawn by customers are ejected. The banknote deposit and withdrawal aperture 5 is opened and closed by driving of a shutter.

The operation and display unit 6 integrates a liquid crystal display (LCD) that displays operation screens during transactions and a touchscreen at which various transaction type selections, PIN numbers, transaction amounts and the like are entered.

The ten-key pad 7 includes physical keys that accept entries of the digits 0 to 9 and the like. The ten-key pad 7 is used during entry operations for PIN numbers, transaction amounts and the like.

The receipt issue aperture 8 is a region at which receipts on which transaction details and the like are printed are issued when transaction processing has been completed. A receipt processing section (which is not shown in the drawings) that prints transaction details and the like on the receipts is disposed at the side behind the receipt issue aperture 8.

A main control section 9, a banknote deposit and withdrawal apparatus 10 and the like are disposed inside the casing 2. The main control section 9 supervises and controls the ATM 1 as a whole. The banknote deposit and withdrawal apparatus 10 performs various processes on banknotes.

Herebelow, descriptions are given with the side of the automatic teller machine 1 that a customer faces being defined as the front side, the opposite side being defined as the rear side, the left and right as viewed by a customer facing the front side being defined as the left side and the right side, and the upper side and the lower side being defined accordingly.

—1-2. Internal Structures of the Banknote Deposit and Withdrawal Apparatus—

Figure 3:
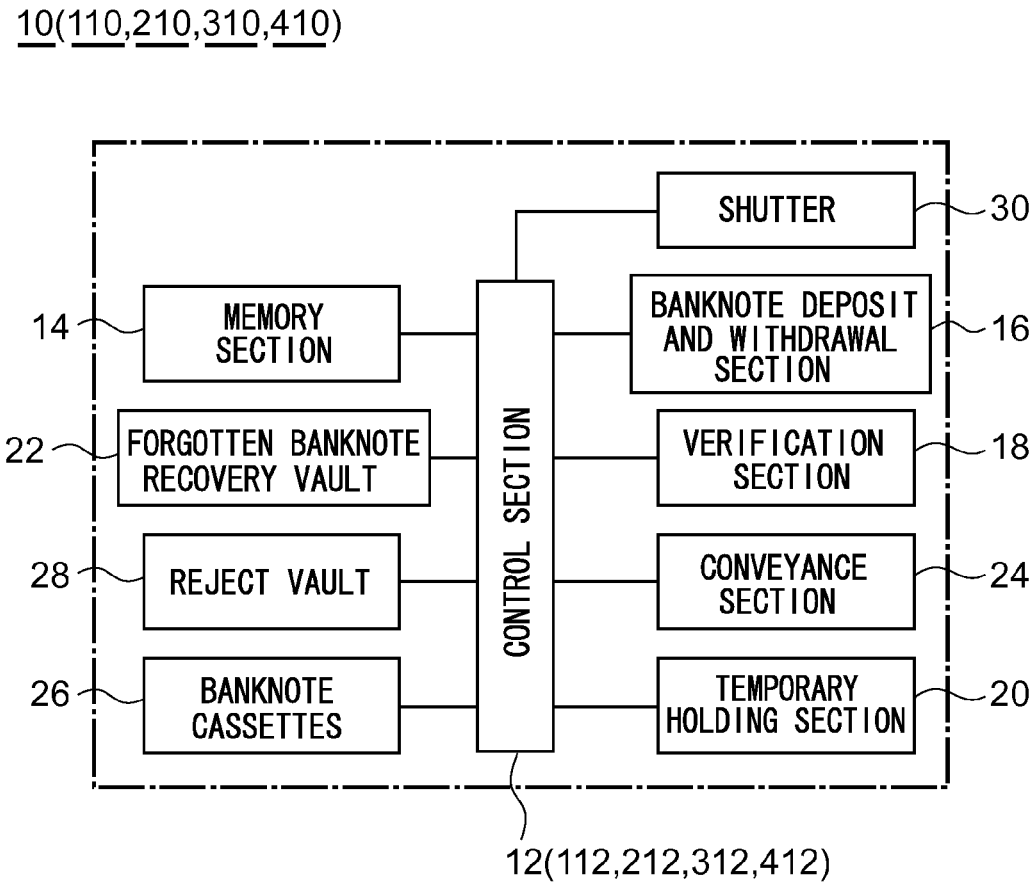
FIG. 3 is a block diagram showing control structures of the banknote deposit and withdrawal apparatus.

As shown in FIG. 3, a control section 12 supervises and controls respective sections of the banknote deposit and withdrawal apparatus 10 (a memory section 14, a forgotten banknote recovery vault 22, a reject vault 28, banknote cassettes 26, a shutter 30, a banknote deposit and withdrawal section 16, a verification section 18, a conveyance section 24 and a temporary holding section 20).

The control section 12 is basically structured around a central processing unit (CPU), which is not shown in the drawings. The control section 12 reads a predetermined program from the memory section 14, which is a read-only memory (ROM), random access memory (RAM), hard disc drive, flash memory or the like, and executes the program. Thus, the control section 12 controls the respective sections and performs various kinds of processing such as deposit transactions, withdrawal transactions and the like. The memory section 14 memorizes results of verification by the verification section 18, counted numbers of banknotes, serial numbers of banknotes and so forth.

Figure 2:
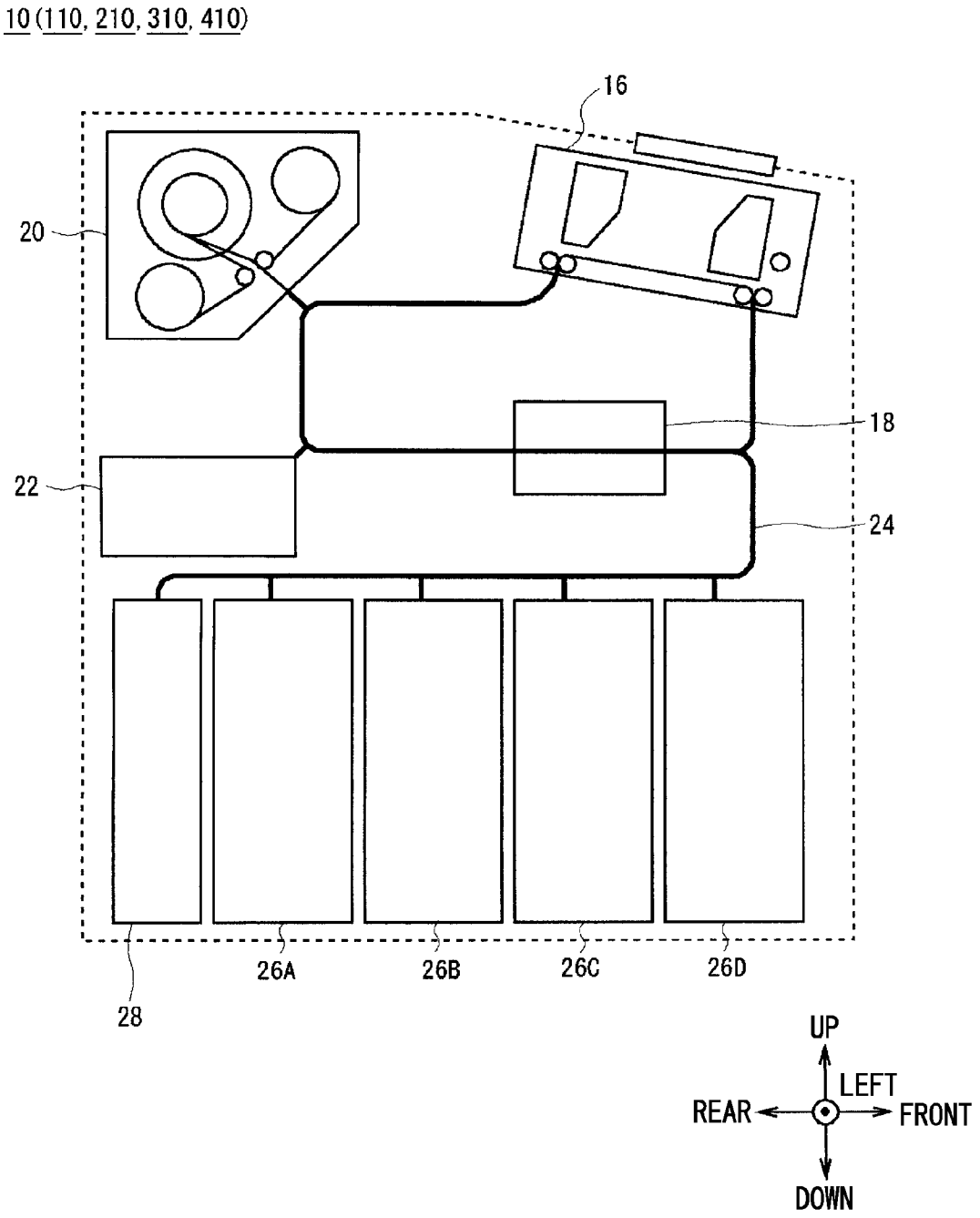
FIG. 2 is a left side diagram showing structures of a banknote deposit and withdrawal apparatus.

As shown in FIG. 2, the banknote deposit and withdrawal section 16, the verification section 18, the temporary holding section 20, the forgotten banknote recovery vault 22 and suchlike are disposed at the upper side of the interior of the banknote deposit and withdrawal apparatus 10. The verification section 18 determines denominations, authenticity and the like of banknotes. The temporary holding section 20 temporarily retains deposited banknotes and the like. The forgotten banknote recovery vault 22 recovers and stores banknotes that a customer has forgotten to take from the banknote deposit and withdrawal section 16 during a transaction.

The conveyance section 24 conveys rectangular banknotes in the direction of the short sides thereof along conveyance paths, which are shown by heavy lines in the drawings, by rollers, belts and the like that are not shown in the drawings. The conveyance section 24 conveys the banknotes so as to pass the banknotes through the verification section 18 in a front-and-rear direction, and connects a rear side of the verification section 18 to each of the temporary holding section 20, the forgotten banknote recovery vault 22 and the banknote deposit and withdrawal section 16. The conveyance section 24 also connects the front side of the verification section 18 with the banknote deposit and withdrawal section 16, the banknote cassettes 26 and the reject vault 28.

Figure 4A:
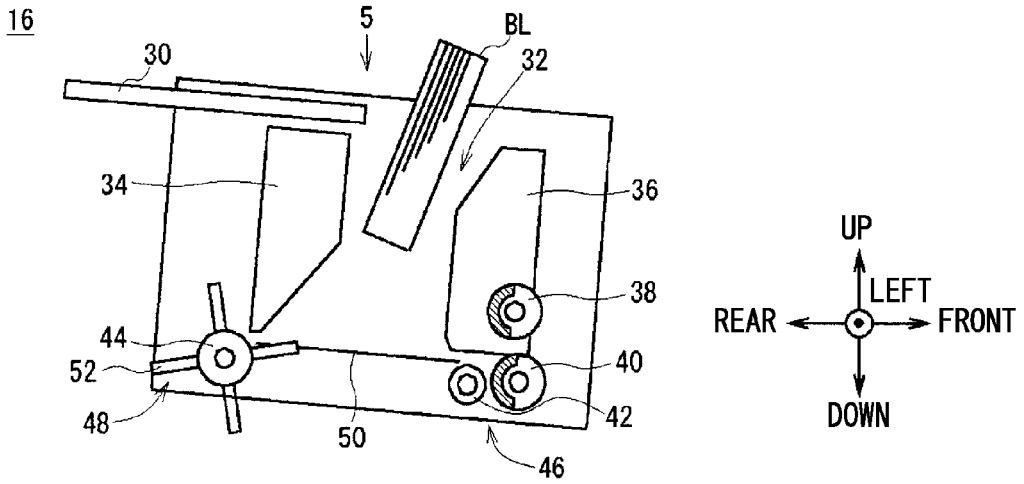
FIG. 4A is a left side diagram showing structures of the banknote deposit and withdrawal apparatus.
Figure 4B:
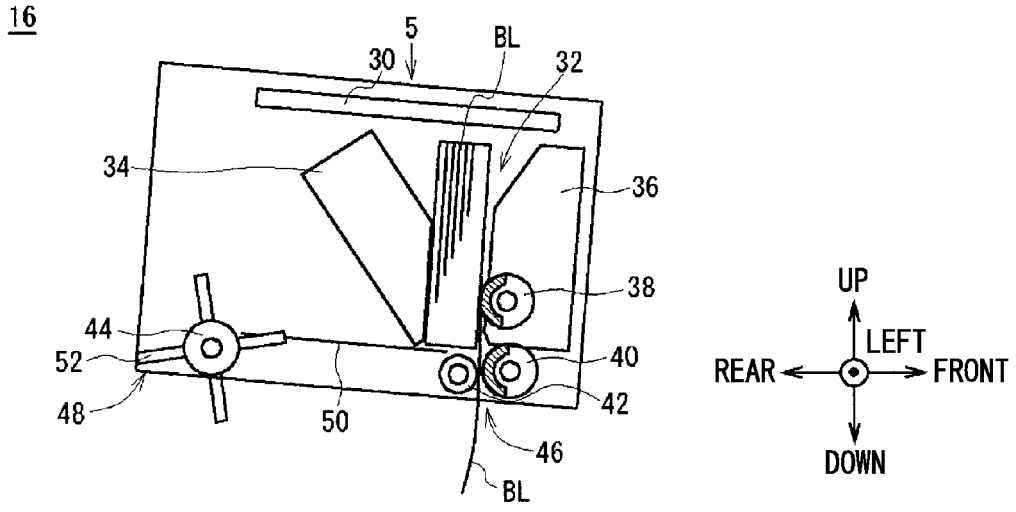
FIG. 4B is a left side diagram showing the structures of the banknote deposit and withdrawal apparatus.
Figure 4C:
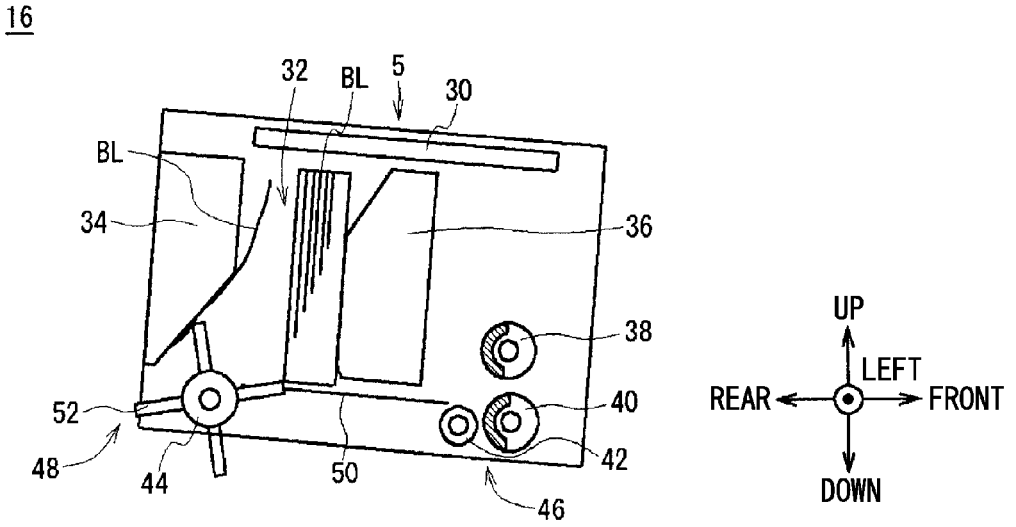
FIG. 4C is a left side diagram showing the structures of the banknote deposit and withdrawal apparatus.

As shown in FIG. 4A to FIG. 4C, the banknote deposit and withdrawal section 16 is principally structured by the shutter 30, a banknote accommodation section 32, a bill press 34, a pool guide 36, various rollers (a picker roller 38, a feed roller 40, a separation roller 42 and a stacking roller 44) and a support plate 50.

The pool guide 36 is disposed to forward of the banknote deposit and withdrawal section 16, to be capable of reciprocating in the front-and-rear direction. An aperture through which an outer periphery face of the picker roller 38 protrudes is provided in the pool guide 36. The bill press 34 is disposed to rearward of the banknote deposit and withdrawal section 16, opposing the pool guide 36, to be capable of reciprocating in the front-and-rear direction.

The picker roller 38 feeds out banknotes BL by turning, in a counterclockwise direction in the drawings, at the front side of the banknote accommodation section 32. The feed roller 40 and the separation roller 42 separate the banknotes BL fed out by the picker roller 38, one at a time, and feed each banknote BL through a feedout aperture 46 to the conveyance section 24 (FIG. 2).

The stacking roller 44, by turning in the clockwise direction in the drawings at the rear side of the banknote accommodation section 32, stacks banknotes that are conveyed from the conveyance section 24 (FIG. 2) in the banknote accommodation section 32 via a stacking aperture 48.

Tongue plates 52 are provided at a turning axle of the stacking roller 44. The tongue plates 52 are formed of resilient members of rubber or the like. By turning in the clockwise direction together with the stacking roller 44, the tongue plates 52 strike against lower end portions of the banknotes BL fed out to the banknote accommodation section 32 and line up the banknotes BL at the side at which the pool guide 36 is disposed.

When banknotes BL are being received from a customer, as shown in FIG. 4A, the banknote deposit and withdrawal section 16 moves the pool guide 36 and bill press 34 to the lower side of substantially the middle of the deposit and withdrawal aperture 5 and opens the shutter 30.

When the banknotes BL inserted into the banknote accommodation section 32 are to be separated one at a time and fed out to the conveyance section 24 (FIG. 2), as shown in FIG. 4B, the banknote deposit and withdrawal section 16 moves the bill press 34 forward and presses the banknotes BL against the picker roller 38 (this state is also referred to as "the feedout state"). The picker roller 38, the feed roller 40 and the separation roller 42 are turned, and the banknotes BL are fed out to the conveyance section 24.

A banknote detection sensor structured by an optical sensor or the like (not shown in the drawings) is provided at the banknote deposit and withdrawal section 16. By verifying whether or not there are any banknotes BL in the banknote accommodation section 32, the banknote detection sensor detects whether or not all of the banknotes BL in the banknote accommodation section 32 have been separated and fed out, and reports the detection results to the control section 12 (FIG. 1).

When abnormal banknotes BL or banknotes BL that are to be withdrawn are to be stacked in the banknote accommodation section 32 via the conveyance section 24 (FIG. 2), as shown in FIG. 4C, the banknote deposit and withdrawal section 16 moves the bill press 34 rearward and moves the pool guide 36 to substantially the middle of the banknote deposit and withdrawal section 16 (this state is also referred to as "the stacking state"). The banknote deposit and withdrawal section 16 turns the stacking roller 44 and takes the banknotes BL into the banknote accommodation section 32, stacking the banknotes BL in superposition with other banknotes BL that are already accommodated in the banknote accommodation section 32.

Thus, although the banknote deposit and withdrawal section 16 accommodates banknotes BL that are to be separated and fed out and banknotes BL that are stacked together in the banknote accommodation section 32, no dividing plate to physically separate these banknotes BL from each other is provided in the banknote accommodation section 32. Therefore, the members are kept simple.

A stacking aperture sensor (not shown in the drawings) is provided in a vicinity of the stacking aperture 48 of the banknote deposit and withdrawal section 16. The stacking aperture sensor is structured by an optical sensor or the like and detects banknotes passing through the stacking aperture 48. The stacking aperture sensor reports the detection results to the control section 12 (FIG. 1). The control section 12 counts numbers of banknotes on the basis of these detection results.

The verification section 18 (FIG. 2), while conveying banknotes thereinside, uses optical components, magnetic sensing components and the like to verify the denominations and authenticity of the banknotes, and levels of damage (intact or damaged) and the like. The verification section 18 reports the verification results to the control section 12 (FIG. 1). In response, the control section 12 determines conveyance destinations of the banknotes in accordance with the acquired verification results.

The verification section 18 reads serial numbers from captured image data of banknotes. The serial numbers are banknote identifier information assigned to individual banknotes and are constituted of alphanumeric characters and the like, pre-printed on one face of each banknote. The verification section 18 counts numbers of the banknotes that are conveyed thereinside and reports the counting results to the control section 12.

The temporary holding section 20 temporarily retains banknotes that a customer inserts into the banknote deposit and withdrawal section 16 during a deposit, temporarily retains normal banknotes that have been verified as suitable for deposit by the verification section 18 until the deposit is confirmed, and ejects abnormal banknotes that are verified as unsuitable for deposit to the banknote deposit and withdrawal section 16, in "last-in first-out" order.

A retention section sensor (not shown in the drawings) is provided in a vicinity of an entry/exit aperture for banknotes at the temporary holding section 20. The retention section sensor is structured by an optical sensor or the like and detects banknotes passing through the entry/exit aperture. The retention section sensor reports the detection results to the control section 12 (FIG. 1). The control section 12 counts numbers of banknotes on the basis of these detection results.

The banknote cassettes 26 for different denominations (26A to 26D) and the reject vault 28 are provided at the lower side of the interior of the banknote deposit and withdrawal apparatus 10. The reject vault 28 stores banknotes that are verified by the verification section 18 as being damaged banknotes (defective notes) and banknotes of denominations that are not to be returned, such as 5,000 yen notes, 2,000 yen notes and the like.

At each banknote cassette 26, banknotes conveyed from the conveyance section 24 are fed in by a storing and feeding mechanism and stored in the banknote cassette 26, and stored banknotes are fed out by the storing and feeding mechanism and supplied to the conveyance section 24.

—1-3. Deposit Processing—

Figure 5:
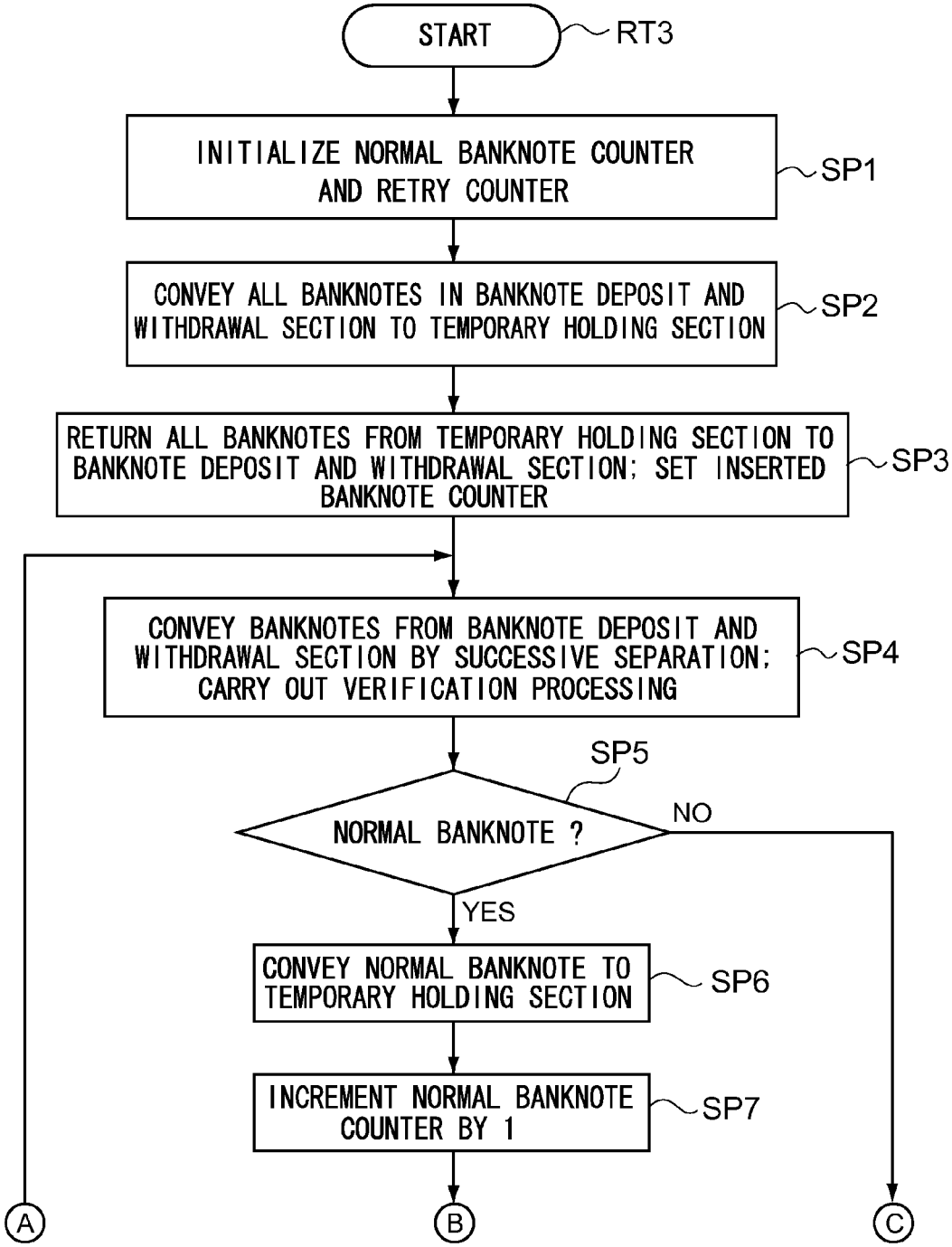
FIG. 5 is a flowchart showing a deposit processing routine in accordance with a first embodiment.
Figure 6:
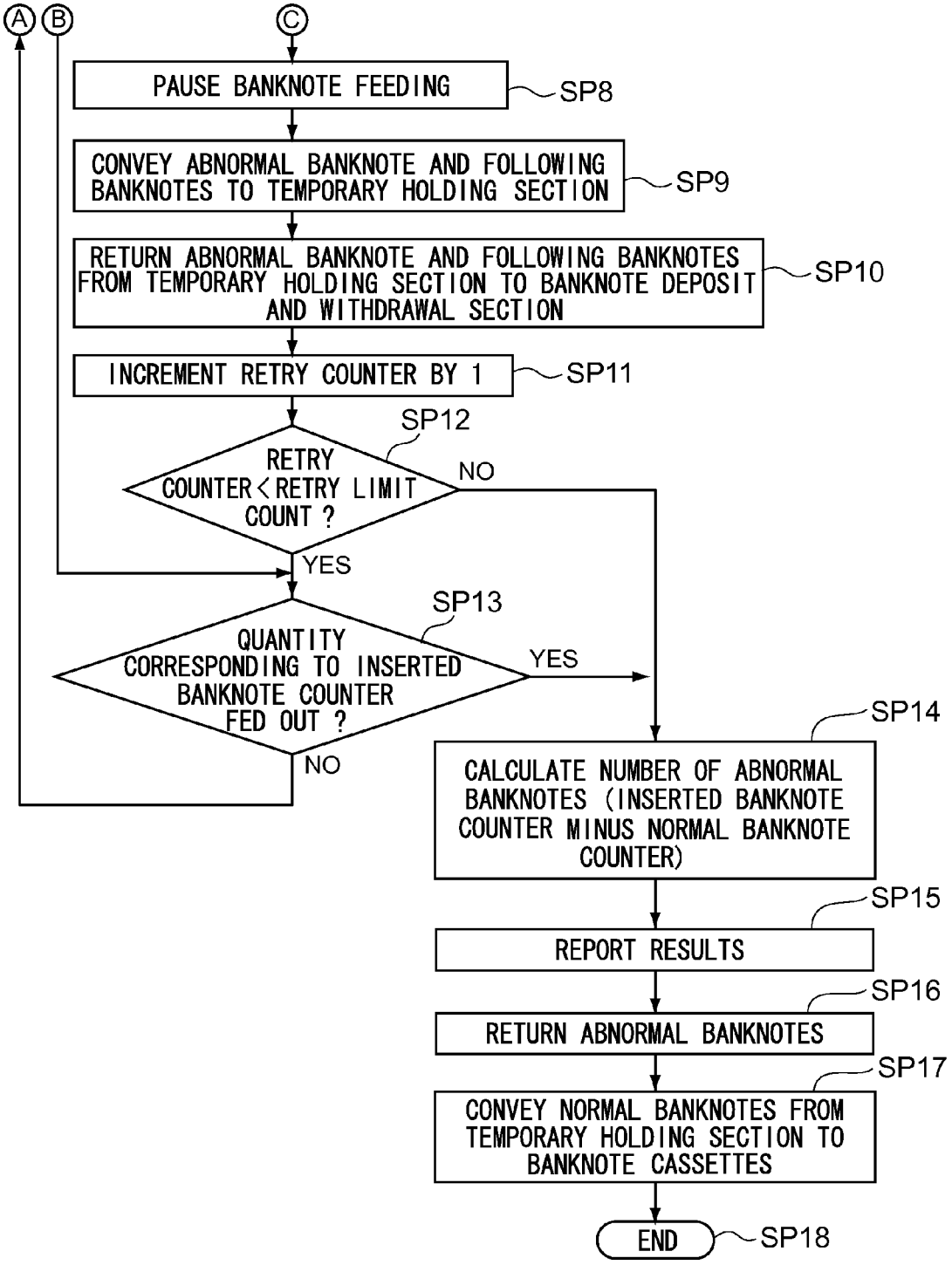
FIG. 6 is a flowchart showing the deposit processing routine in accordance with the first embodiment.

Now, a specific processing routine of deposit processing by the ATM 1 is described in detail using the flowcharts in FIG. 5 and FIG. 6.

When a customer is performing a deposit transaction to deposit banknotes, the control section 12 of the banknote deposit and withdrawal apparatus 10 receives a predetermined operation entry via the operation and display unit 6 and then opens the shutter 30 of the deposit and withdrawal aperture 5 to allow the insertion of banknotes into the banknote accommodation section 32.

The control section 12 reads a deposit processing program from the memory section 14 and executes the deposit processing program. Thus, the control section 12 starts the deposit processing routine RT1 and proceeds to step SP1.

In step SP1, the control section 12 initializes a normal banknote counter and a retry counter to zero, and then proceeds to step SP2.

This normal banknote counter represents a number of banknotes verified as normal banknotes by the verification section 18. The retry counter represents a number of times that abnormal banknotes are detected by the verification section 18, the abnormal banknotes and following banknotes are temporarily returned to the banknote deposit and withdrawal section 16, and the banknotes are then fed from the banknote deposit and withdrawal section 16 again (that is, a number of times the verification operation is re-tried).

Figure 7:
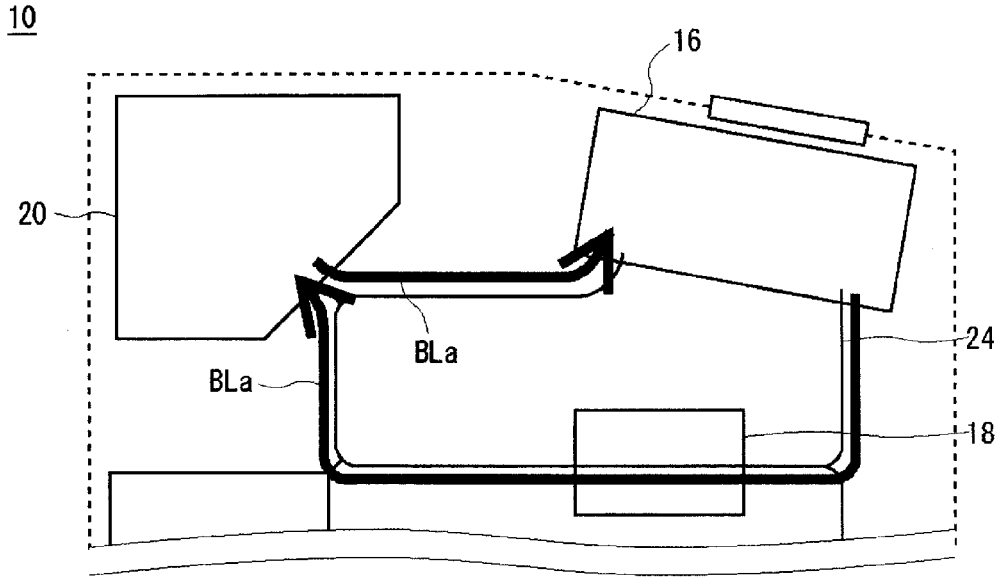
FIG. 7 is a schematic diagram showing paths of banknotes in accordance with the first embodiment.

In step SP2, the control section 12 switches the banknote deposit and withdrawal section 16 to the feedout state and conveys all inserted banknotes BLa, which are all of the banknotes inserted into the banknote deposit and withdrawal section 16, through the verification section 18 to the temporary holding section 20, as shown in FIG. 7.

In step SP3, the control section 12 switches the banknote deposit and withdrawal section 16 from the feedout state to the stacking state and conveys the all inserted banknotes BLa retained at the temporary holding section 20 to the banknote deposit and withdrawal section 16, as shown in FIG. 7. At this time, the control section 12 counts the number of banknotes on the basis of the detection results reported from the stacking aperture sensor, sets an inserted banknote counter, and then proceeds to step SP4. This inserted banknote counter represents an inserted banknotes number, which is the total number of inserted banknotes that the customer has inserted into the banknote deposit and withdrawal section 16.

Thus, before conveying the banknotes to the verification section 18 and carrying out verification operations to determine conveyance destinations of the banknotes on the basis of determination results, the control section 12 is configured to count the total number of the all inserted banknotes BLa to obtain the inserted banknotes number.

In step SP4, the control section 12 conveys the banknotes to the verification section 18 by successive separation of the banknotes from the banknote deposit and withdrawal section 16 one at a time, determines whether a banknote is a normal banknote or an abnormal banknotes by carrying out verification processing, and then proceeds to step SP5.

The meaning of the term "successive separation" herein refers to the banknote deposit and withdrawal section 16 successively separating the banknotes that are present in the banknote accommodation section 32, one by one, and feeding each banknote out to the conveyance section 24 before a preceding banknote has been verified by the verification section 18. Thus, the banknote deposit and withdrawal apparatus 10 may complete the deposit processing in a short duration, even taking account of verification processing durations at the verification section 18, operation durations of switching blades that are provided at junctions of the conveyance section 24 (which are not shown in the drawings), and the like.

Accordingly, in the successive separation, when a banknote fed out from the banknote deposit and withdrawal section 16 is verified by the verification section 18, one or a plural number of following banknotes are present in the conveyance section 24 between the verification section 18 and the banknote deposit and withdrawal section 16.

Figure 8:
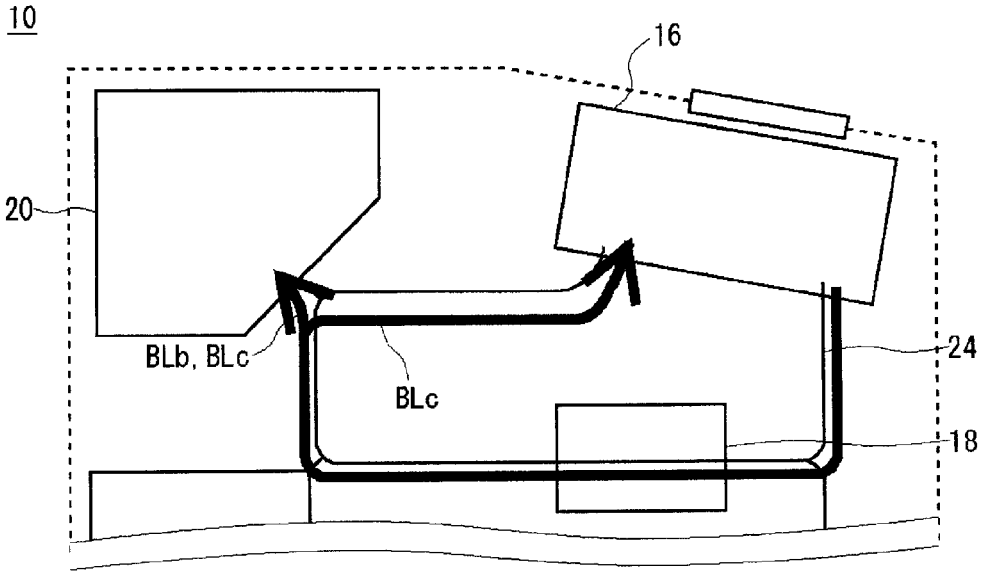
FIG. 8 is a schematic diagram showing paths of banknotes in accordance with the first embodiment.

In step SP5, if it is determined that a banknote is a normal banknote, the control section 12 proceeds to step SP6, conveys the normal banknote BLb to the temporary holding section 20 as shown in FIG. 8 and retains the normal banknote BLb therein, and then proceeds to step SP7.

In step SP7, the control section 12 counts a number of banknotes on the basis of detection results reported from the retention section sensor and increments the normal banknote counter, and then proceeds to step SP13.

On the other hand, if it is determined in step SP5 that a banknote is an abnormal banknote, the control section 12 proceeds to step SP8, pauses the feeding of banknotes from the banknote deposit and withdrawal section 16, and then proceeds to step SP9.

In step SP9, as shown in FIG. 8, the control section 12 conveys the banknote that is determined by the verification section 18 to be an abnormal banknote BLc along the conveyance section 24 and conveys the abnormal banknote BLc to the temporary holding section 20 with the following banknotes that have not yet been verified by the verification section 18 (hereinafter these are collectively referred to as "the abnormal banknotes BLc"), retains these abnormal banknotes BLc at the temporary holding section 20, and then proceeds to step SP10.

In step SP10, the control section 12 switches the banknote deposit and withdrawal section 16 from the feedout state to the stacking state, conveys the abnormal banknotes BLc retained in the temporary holding section 20 to the banknote deposit and withdrawal section 16 as shown in FIG. 8, and then proceeds to step SP11.

In step SP11, the control section 12 increments the retry counter by one and then proceeds to step SP12.

In step SP12, the control section 12 makes a determination as to whether the retry counter is smaller than a retry limit count.

The term "retry limit count" represents a maximum value of a number of times verification operations are resumed after an abnormal banknote has been detected by the verification section 18 (a number of retries), which is specified in advance.

If an affirmative result is obtained in step SP12, this means that, because the retry counter has not reached the retry count limit, subsequent verification operations will continue to be carried out. In this case, the control section 12 proceeds to step SP13.

In step SP13, the control section 12 makes a determination as to whether the banknotes have been fed from the banknote deposit and withdrawal section 16 in a quantity corresponding to the inserted banknote counter.

If a negative result is obtained in step SP13, this means that subsequent verification operations will continue to be carried out. In this case, the control section 12 returns to step SP4 and feeding of the banknotes from the banknote deposit and withdrawal section 16 continues.

On the other hand, if a negative result is obtained in step SP12, this means that, because the retry counter has reached the retry limit count, further verification operations will not be carried out. In this case, the control section 12 proceeds to step SP14.

If a negative result is obtained in step SP13, this means that, because the banknotes have been fed from the banknote deposit and withdrawal section 16 in a quantity corresponding to the inserted banknote counter, all of the banknotes inserted at the banknote deposit and withdrawal section 16 have gone through verification. In this case too, the control section 12 proceeds to step SP14.

In step SP14, the control section 12 calculates a number of abnormal banknotes by subtracting the normal banknote counter from the inserted banknote counter, and then proceeds to step SP15.

In step SP15, the control section 12 reports the numbers of normal banknotes and abnormal banknotes in the current deposit process to the customer, via the operation and display unit 6, and then proceeds to step SP16.

In step SP16, the control section 12 returns the abnormal banknotes that are stacked in the banknote deposit and withdrawal section 16 to the customer. In step SP17, the control section 12 conveys the normal banknotes that are retained in the temporary holding section 20 to the banknote cassettes 26. The control section 12 then proceeds to step SP18 and ends the deposit processing routine RT1.

If all of the inserted banknotes are normal banknotes, when the control section 12 obtains an affirmative result in step SP13, the control section 12 calculates the abnormal banknotes number to be zero in step SP14 and reports only the number of normal banknotes to the customer in step SP15. The control section 12 conveys the normal banknotes in step SP17 without returning any abnormal banknotes in step SP16, and then proceeds to step SP18 and ends the deposit processing routine RT1.

—1-4. Operation and Effects—

The banknote deposit and withdrawal apparatus 10 with the structure described above first counts the inserted banknotes number without performing verifications. Then, the banknote deposit and withdrawal apparatus 10 performs verifications with the verification section 18. The banknote deposit and withdrawal apparatus 10 conveys normal banknotes to the temporary holding section 20 and counts the normal banknotes, but conveys abnormal banknotes to the banknote deposit and withdrawal section 16 via the temporary holding section 20 and stacks the abnormal banknotes in the banknote deposit and withdrawal section 16.

After the inserted banknotes stored in the banknote deposit and withdrawal section 16 have gone through verification, the banknote deposit and withdrawal apparatus 10 calculates the abnormal banknotes number by subtracting the normal banknotes number from the inserted banknotes number.

Now, there may be cases in which plural abnormal banknotes overlap and are multiply fed or the like. Therefore, if the banknote deposit and withdrawal apparatus 10 simply counted the number of banknotes determined to be abnormal by the verification section 18, it might not be possible for the banknote deposit and withdrawal apparatus 10 to accurately identify the abnormal banknotes number.

However, the banknote deposit and withdrawal apparatus 10 uses the normal banknotes number that may be accurately counted one at a time. Therefore, the banknote deposit and withdrawal apparatus 10 may accurately calculate the abnormal banknotes number and may prevent problems for customers.

Furthermore, by just performing the simple operation of counting the inserted banknotes number before verification operations of the banknotes, the banknote deposit and withdrawal apparatus 10 may thereafter accurately calculate the number of abnormal banknotes in the verification operations.

In a case in which a banknote deposit and withdrawal mechanism includes a banknote deposit and withdrawal section that is provided with a divider that physically separates banknotes to be separated and fed from stacked banknotes, inserted banknotes are verified by a verification section without the inserted banknotes number being counted, and normal banknotes are retained in a temporary holding section but abnormal banknotes are stacked in the banknote deposit and withdrawal section.

In this banknote deposit and withdrawal section, because the abnormal banknotes are physically separated by the divider from banknotes that are to be fed out, the banknotes are not united. Therefore, because the banknote deposit and withdrawal apparatus 10 may physically separate and manage the banknotes to be fed out from the banknote deposit and withdrawal section 16 and the banknotes stacked in the banknote deposit and withdrawal section 16, the banknote deposit and withdrawal apparatus 10 may accurately identify a number of abnormal banknotes.

In contrast, the banknote deposit and withdrawal section 16 according to the present embodiment is not provided with a divider that physically separates banknotes to be separated and fed from stacked banknotes. Thus, members may be simplified and costs may be reduced. In the banknote deposit and withdrawal section 16, abnormal banknotes touch against and are stacked with banknotes that are to be fed out. Therefore, the banknote deposit and withdrawal apparatus 10 does not physically separate and manage banknotes that are to be fed and banknotes that are stacked in the banknote deposit and withdrawal section 16. Consequently, it may be that the banknote deposit and withdrawal apparatus 10 cannot accurately identify a number of abnormal banknotes.

However, the banknote deposit and withdrawal apparatus 10 according to the present embodiment may accurately calculate the abnormal banknotes number by first confirming the inserted banknotes number and thereafter subtracting normal banknotes, which may be accurately counted one at a time, from the inserted banknotes number.

According to the structure described above, the banknote deposit and withdrawal apparatus 10 causes the control section 12 to function as an inserted medium counting unit, a normal medium counting unit and an abnormal mediums number calculation unit. The inserted medium counting unit counts an inserted mediums number, which is the total number of banknotes fed out from the banknote deposit and withdrawal section 16, by feeding out all the banknotes from the banknote deposit and withdrawal section 16, which accommodates banknotes to be fed out and stacked banknotes without dividing therebetween, and subsequently conveying to the banknote deposit and withdrawal section 16 banknotes that have been conveyed through the verification section 18 to the temporary holding section 20. The normal medium counting unit again feeds out and conveys banknotes from the banknote deposit and withdrawal section 16 to the verification section 18 in a quantity corresponding to the number of inserted banknotes, conveys abnormal banknotes that are verified as being abnormal by the verification section 18 to the banknote deposit and withdrawal section 16 together with following banknotes, and conveys normal banknotes that are verified as being normal by the verification section 18 to the temporary holding section 20 and retains the normal banknotes therein, and counts a normal banknotes number, which is the total number of the normal banknotes. The abnormal mediums number calculation unit subtracts the normal banknotes number from the inserted banknotes number and calculates an abnormal banknotes number, which is the number of the abnormal banknotes.

Thus, even though banknotes to be fed out and stacked banknotes are accommodated without being divided in the banknote deposit and withdrawal section 16, the banknote deposit and withdrawal apparatus 10 may, just by performing the simple operation of counting the inserted banknotes number before verification operations of the banknotes, thereafter accurately calculate the abnormal banknotes number from the verification operations.

2. Second Embodiment

—2-1. Structure of the Banknote Deposit and Withdrawal Apparatus—

As indicated in FIG. 1, an ATM 101 according to the second embodiment is structured similarly to the ATM 1 according to the first embodiment except in that a banknote deposit and withdrawal apparatus 110 differs from the banknote deposit and withdrawal apparatus 10.

As indicated in FIG. 3, the banknote deposit and withdrawal apparatus 110 has a similar structure to the banknote deposit and withdrawal apparatus 10 except in that a control section 112 differs from the control section 12.

—2-2. Deposit Processing—

When a customer is performing a deposit transaction to deposit banknotes, the control section 112 of the banknote deposit and withdrawal apparatus 110 receives a predetermined operation entry via the operation and display unit 6 and then opens the shutter 30 of the deposit and withdrawal aperture 5 to allow the insertion of banknotes into the banknote accommodation section 32.

Figure 9:
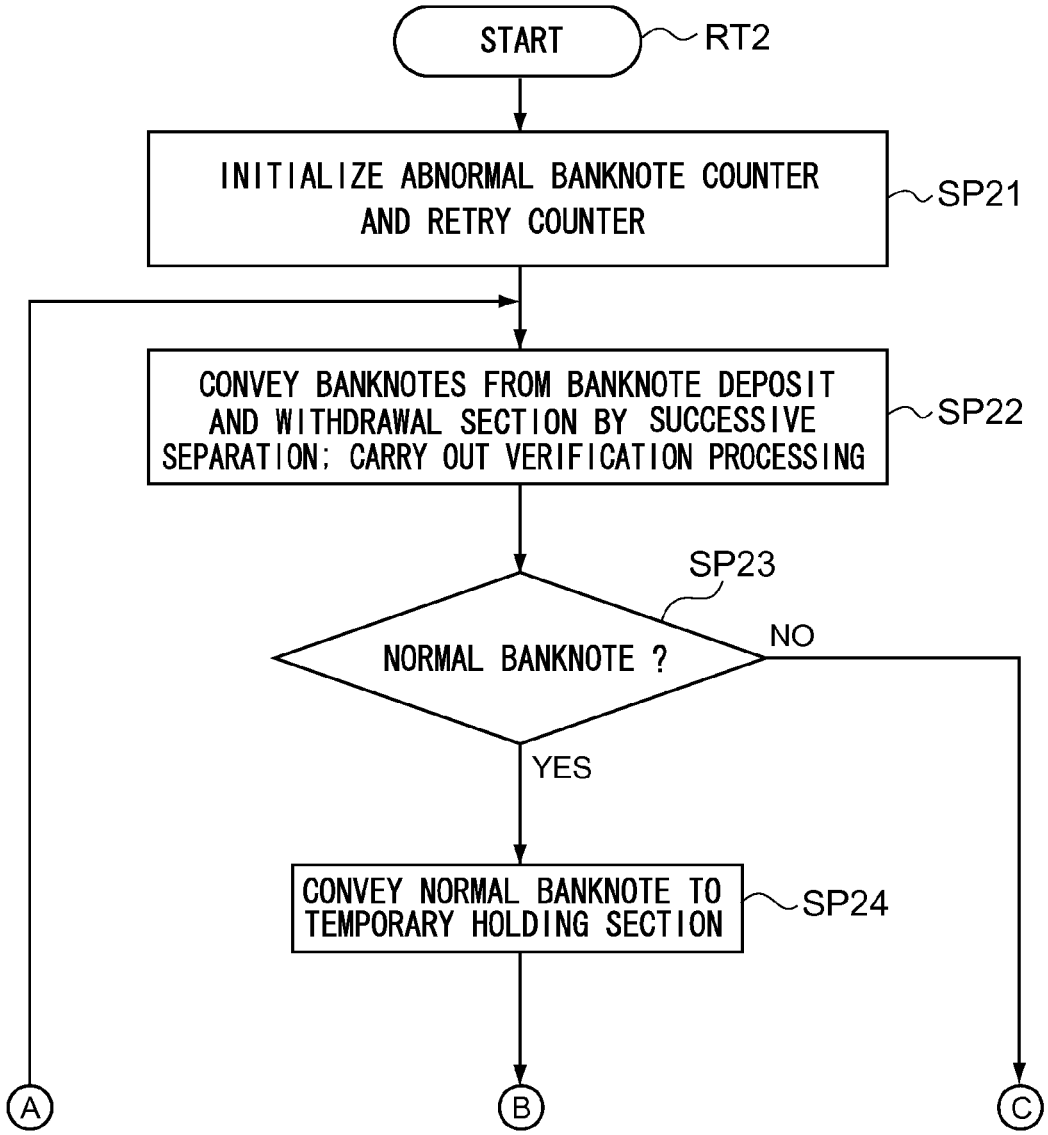
FIG. 9 is a flowchart showing a deposit processing routine in accordance with a second embodiment.

The control section 112 reads a deposit processing program from the memory section 14 and executes the deposit processing program. Thus, the control section 112 starts the deposit processing routine RT2 shown in FIG. 9 and FIG. 10 and proceeds to step SP21.

In step SP21, the control section 112 initializes an abnormal banknote counter and a retry counter to zero, and then proceeds to step SP22. This abnormal banknote counter represents a number of banknotes verified as being abnormal banknotes by the verification section 18.

In step SP22, the control section 112 successively separates banknotes from the banknote deposit and withdrawal section 16 one at a time, hence conveying the banknotes to the verification section 18. By verification processing, the control section 112 makes a determination as to whether each banknote is a normal banknote or an abnormal banknote, and then proceeds to step SP23.

Figure 11:
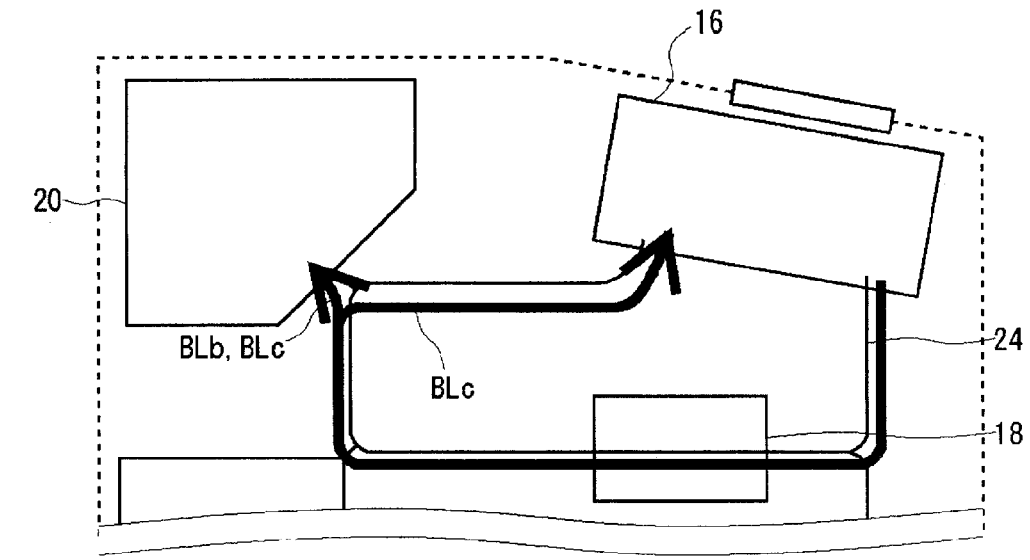
FIG. 11 is a schematic diagram showing paths of banknotes in accordance with the second embodiment.

In step SP23, if it is determined that a banknote is a normal banknote, the control section 112 proceeds to step SP24, conveys the normal banknote BLb from the verification section 18 to the temporary holding section 20 as shown in FIG. 11 and retains the normal banknote BLb in the temporary holding section 20. Then the control section 112 proceeds to step SP30.

On the other hand, if it is determined in step SP23 that a banknote is an abnormal banknote, the control section 112 proceeds to step SP25. From step SP25 to step SP29, the control section 112 carries out processing the same as step SP8 to step SP12 of the deposit processing routine RT1 according to the first embodiment described above (FIG. 6).

Thus, as shown in FIG. 11, the control section 112 conveys the banknote that is determined by the verification section 18 to be an abnormal banknote BLc along the conveyance section 24 and conveys the abnormal banknote BLc to the temporary holding section 20 with the following banknotes that have not yet been verified by the verification section 18 (hereinafter these are collectively referred to as "the abnormal banknotes BLc"), retains these abnormal banknotes BLc at the temporary holding section 20, then conveys the abnormal banknotes BLc to the banknote deposit and withdrawal section 16, and then proceeds to step SP30.

In step SP30, on the basis of detection results reported from the banknote detection sensor at the banknote deposit and withdrawal section 16, the control section 112 makes a determination as to whether all of the banknotes in the banknote deposit and withdrawal section 16 have been fed out.

If a negative result is obtained in step SP30, this means that subsequent verification operations will continue to be carried out. In this case, the control section 112 returns to step SP22 and the feeding of banknotes from the banknote deposit and withdrawal section 16 continues.

On the other hand, if an affirmative result is obtained in step SP30, this means that, because all the banknotes have been fed out from the banknote deposit and withdrawal section 16, all of the banknotes inserted at the banknote deposit and withdrawal section 16 have gone through verification. In this case, the control section 112 proceeds to step SP31.

In this state, the normal banknotes are retained at the temporary holding section 20 and the abnormal banknotes are stacked in the banknote deposit and withdrawal section 16. Accordingly, the control section 112 performs the processing described below to count the abnormal banknotes stacked in the banknote deposit and withdrawal section 16.

Figure 12:
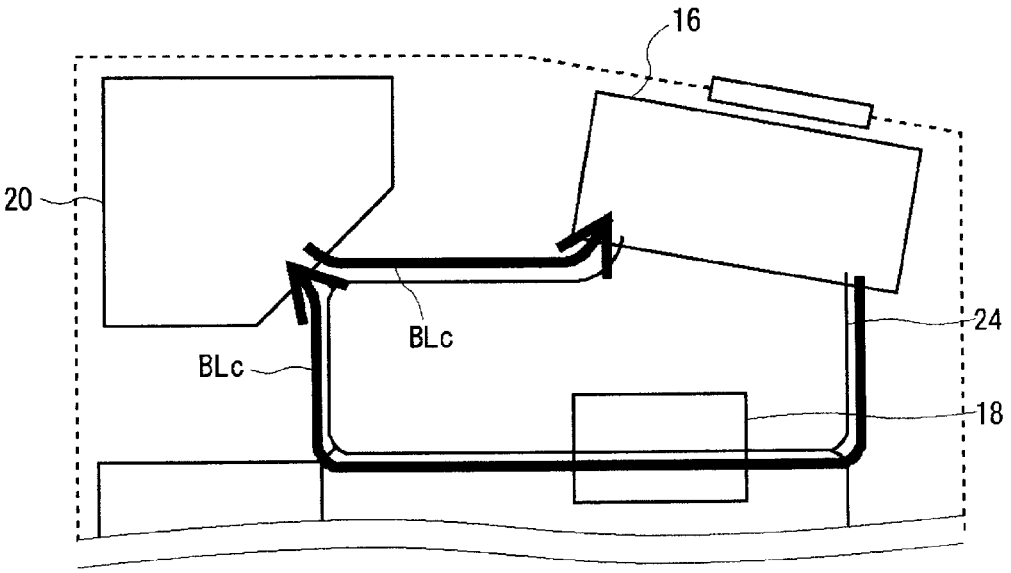
FIG. 12 is a schematic diagram showing paths of banknotes in accordance with the second embodiment.

In step SP31, the control section 112 switches the banknote deposit and withdrawal section 16 into the feedout state and conveys all of the abnormal banknotes BLc stacked in the banknote deposit and withdrawal section 16 to the temporary holding section 20 via the verification section 18, as shown in FIG. 12.

In step SP32, the control section 112 switches the banknote deposit and withdrawal section 16 from the feedout state to the stacking state, and conveys all the abnormal banknotes BLc retained at the temporary holding section 20 to the banknote deposit and withdrawal section 16, as shown in FIG. 12. At this time, the control section 112 counts the number of the banknotes on the basis of detection results reported from the stacking aperture sensor. The control section 112 sets the abnormal banknote counter and then proceeds to step SP33.

From step SP33 to step SP36, the control section 112 carries out processing the same as step SP15 to step SP18 of the deposit processing routine RT1 according to the first embodiment described above (FIG. 6), and the control section 112 ends the deposit processing routine RT2.

If all of the inserted banknotes are normal banknotes, when the control section 112 obtains an affirmative result in step SP30, the control section 112 does not carry out the processing of step SP31 and step SP32 and reports only the number of normal banknotes to the customer in step SP33. The control section 112 conveys the normal banknotes in step SP35 without returning any abnormal banknotes in step SP34, and then proceeds to step SP36 and ends the deposit processing routine RT2.

—2-3. Operation and Effects—

The banknote deposit and withdrawal apparatus 110 with the structure described above performs verifications of the banknotes inserted at the banknote deposit and withdrawal section 16 with the verification section 18. The banknote deposit and withdrawal apparatus 110 conveys normal banknotes to the temporary holding section 20, and conveys abnormal banknotes to the banknote deposit and withdrawal section 16 via the temporary holding section 20 and stacks the abnormal banknotes in the banknote deposit and withdrawal section 16.

After the inserted banknotes have gone through verification, the banknote deposit and withdrawal apparatus 110 conveys the abnormal banknotes stacked in the banknote deposit and withdrawal section 16 through the temporary holding section 20 to the banknote deposit and withdrawal section 16, stacks these banknotes in the banknote deposit and withdrawal section 16, and counts the abnormal banknotes number.

Thus, whereas it is necessary to count all of the inserted banknotes and also count the normal banknotes in the banknote deposit and withdrawal apparatus 10 according to the first embodiment described above, in the banknote deposit and withdrawal apparatus 110 according to the present embodiment, the normal banknotes are removed and only the number of the abnormal banknotes stacked in the banknote deposit and withdrawal section 16 is counted.

Therefore, because there is a high probability that the number of abnormal banknotes stacked in the banknote deposit and withdrawal section 16 is reduced compared to the number of inserted banknotes, the banknote deposit and withdrawal apparatus 110 may make a duration required for the processing of operations to confirm the abnormal banknotes number shorter than in the banknote deposit and withdrawal apparatus 10.

According to the structure described above, the banknote deposit and withdrawal apparatus 110 causes the control section 112 to function as a medium division and conveyance unit and an abnormal medium counting unit. The medium division and conveyance unit feeds out all banknotes from the banknote deposit and withdrawal section 16, which accommodates banknotes to be fed out and stacked banknotes without dividing therebetween, conveys the banknotes to the verification section 18, conveys abnormal banknotes that are verified as being abnormal at the verification section 18 to the banknote deposit and withdrawal section 16 together with following banknotes, but conveys normal banknotes that are verified as being normal by the verification section 18 to the temporary holding section 20 and retains the normal banknotes therein. The abnormal medium counting section feeds out all of the abnormal banknotes from the banknote deposit and withdrawal section 16 and conveys the abnormal banknotes to the temporary holding section 20, and then conveys the abnormal banknotes to the banknote deposit and withdrawal section 16 and counts the abnormal banknotes number, which is the total number of the abnormal banknotes.

Thus, even though banknotes to be fed out and stacked banknotes are accommodated without being divided in the banknote deposit and withdrawal section 16, the banknote deposit and withdrawal apparatus 110 may accurately calculate the abnormal banknotes number in a short duration.

3. Third Embodiment

—3-1. Structure of the Banknote Deposit and Withdrawal Apparatus—

As indicated in FIG. 1, an ATM 201 according to the third embodiment is structured similarly to the ATM 1 according to the first embodiment except in that a banknote deposit and withdrawal apparatus 210 differs from the banknote deposit and withdrawal apparatus 10.

As indicated in FIG. 3, the banknote deposit and withdrawal apparatus 210 has a similar structure to the banknote deposit and withdrawal apparatus 10 except in that a control section 212 differs from the control section 12.

—3-2. Deposit Processing—

Figure 13:
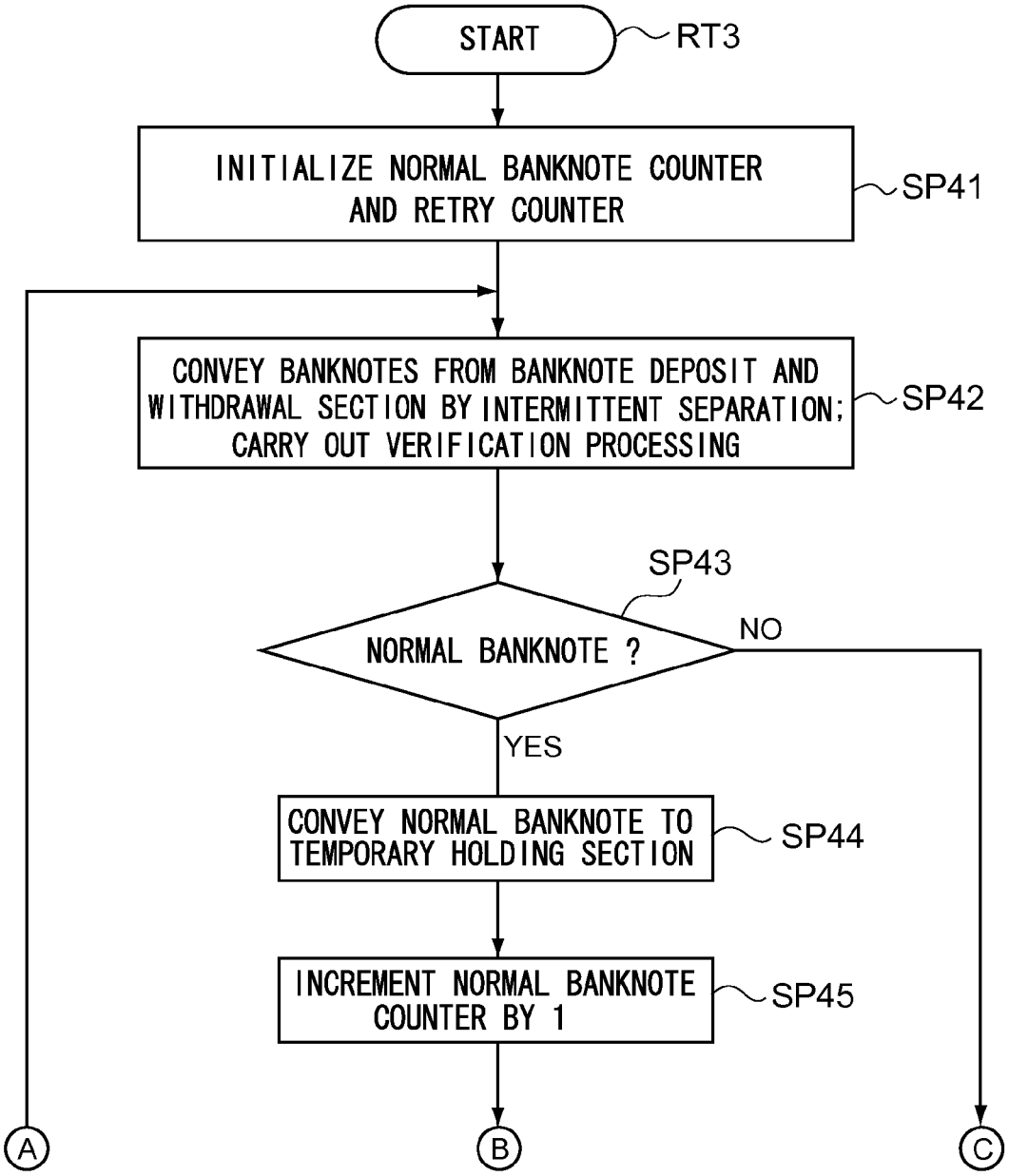
FIG. 13 is a flowchart showing a deposit processing routine in accordance with a third embodiment.
Figure 14:
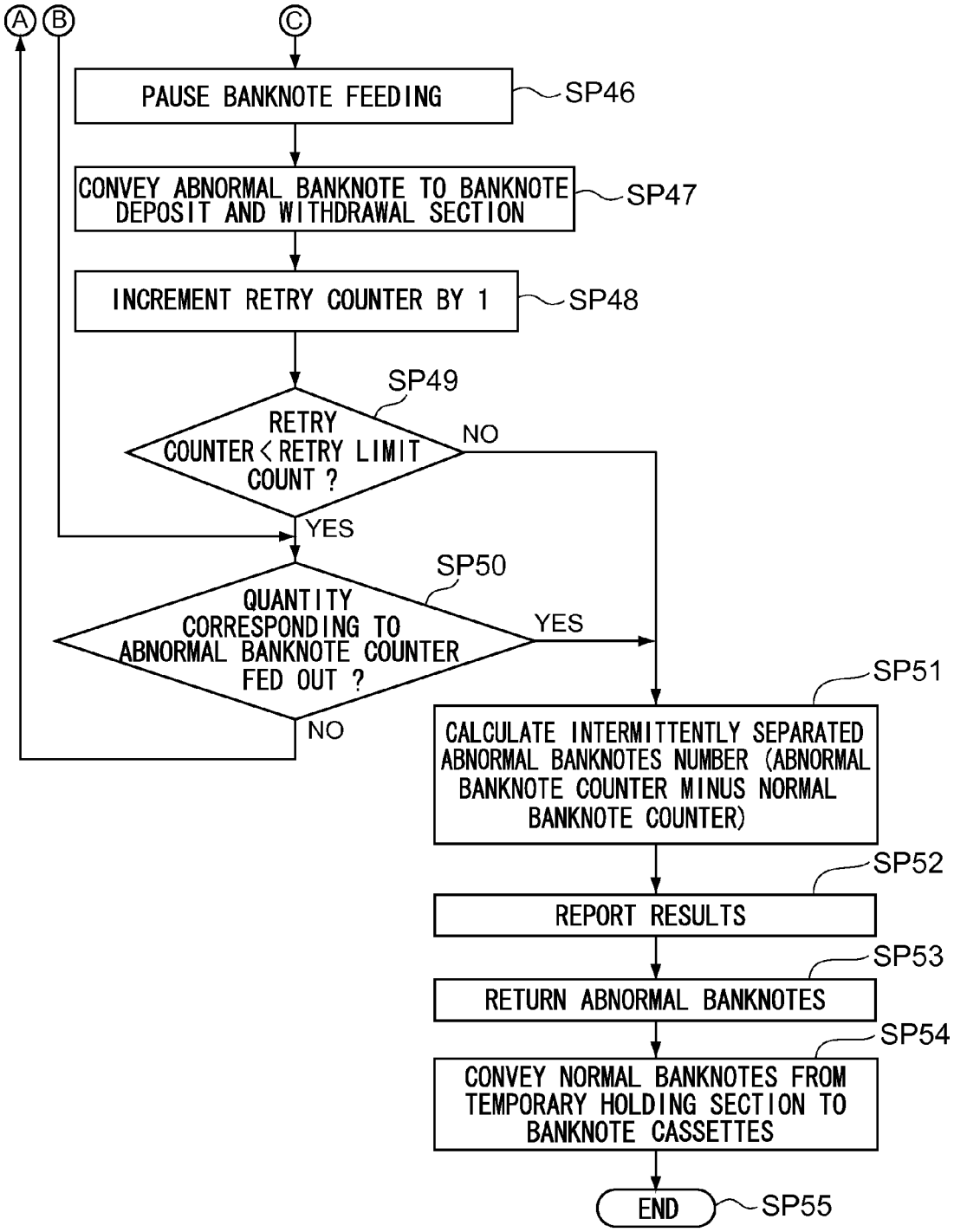
FIG. 14 is a flowchart showing the deposit processing routine in accordance with the third embodiment.

The control section 212 carries out processing the same as in step SP21 to step SP32 of the deposit processing routine RT2 (FIG. 9 and FIG. 10), and then begins a deposit processing routine RT3 shown in FIG. 13 and FIG. 14, proceeding to step SP41.

While the control section 212 is carrying out the processing up to step SP32 of the deposit processing routine RT2, the banknotes that are stacked in the banknote deposit and withdrawal section 16 as abnormal banknotes may include banknotes that are actually normal banknotes. Therefore, by the following processing, the control section 212 extracts banknotes that are actually normal from the banknotes that have been stacked in the banknote deposit and withdrawal section 16 as abnormal banknotes.

In step SP41, the control section 212 initializes a normal banknote counter and a retry counter to zero, and then proceeds to step SP42.

In step SP42, the control section 212 conveys the banknotes to the verification section 18 by intermittent separation of the banknotes from the banknote deposit and withdrawal section 16 one at a time, makes a determination as to whether each banknote is a normal banknote or an abnormal banknote by verification processing, and then proceeds to step SP43.

The term "intermittent separation" herein refers to the banknote deposit and withdrawal section 16 separating the banknotes that are present in the banknote accommodation section 32 one by one and feeding each banknote out to the conveyance section 24 after each preceding banknote has been verified by the verification section 18.

As a result, in the intermittent separation, when a banknote fed out from the banknote deposit and withdrawal section 16 is verified by the verification section 18, no following banknotes are present in the conveyance section 24 between the verification section 18 and the banknote deposit and withdrawal section 16.

Figure 15:
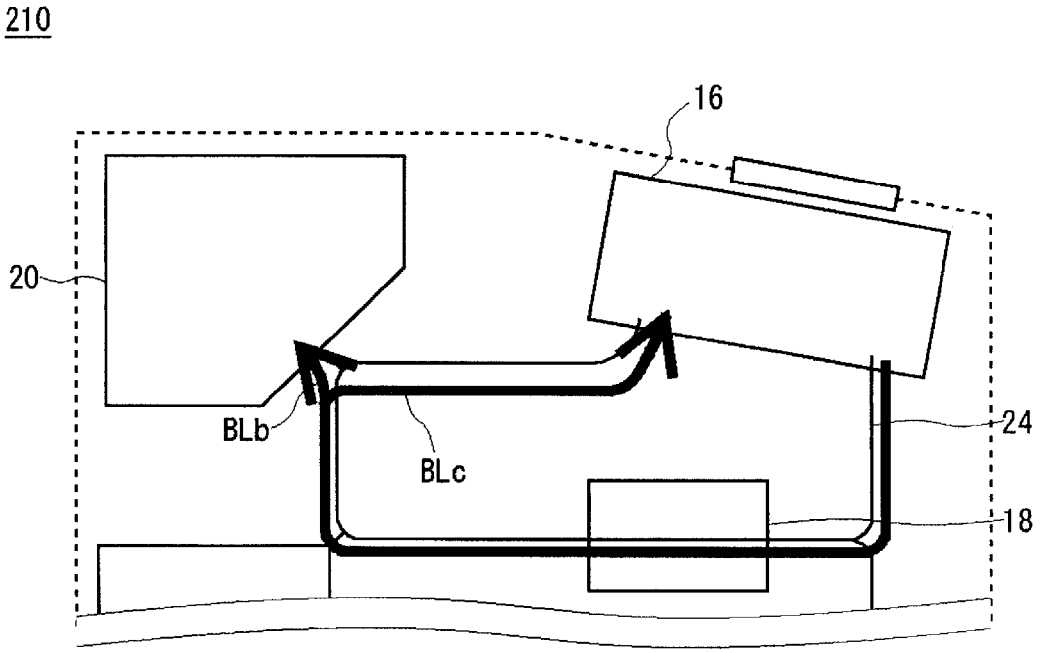
FIG. 15 is a schematic diagram showing paths of banknotes in accordance with the third embodiment.

From step SP43 to step SP46, the control section 212 carries out processing the same as in step SP5 to step SP8 of the deposit processing routine RT1 according to the first embodiment (FIG. 5 and FIG. 6), conveys a normal banknote BLb to the temporary holding section 20 as shown in FIG. 15, and proceeds to step SP47.

In step SP47, as shown in FIG. 15, the control section 212 switches the banknote deposit and withdrawal section 16 from the feedout state to the stacking state and conveys an abnormal banknote BLc to the banknote deposit and withdrawal section 16 without conveying the abnormal banknote BLc to the temporary holding section 20. Then the control section 212 proceeds to step SP48.

In step SP48 and step SP49, the control section 212 carries out processing the same as in step SP11 and step SP12 of the deposit processing routine RT1 (FIG. 6), and proceeds to step SP50.

Figure 10:
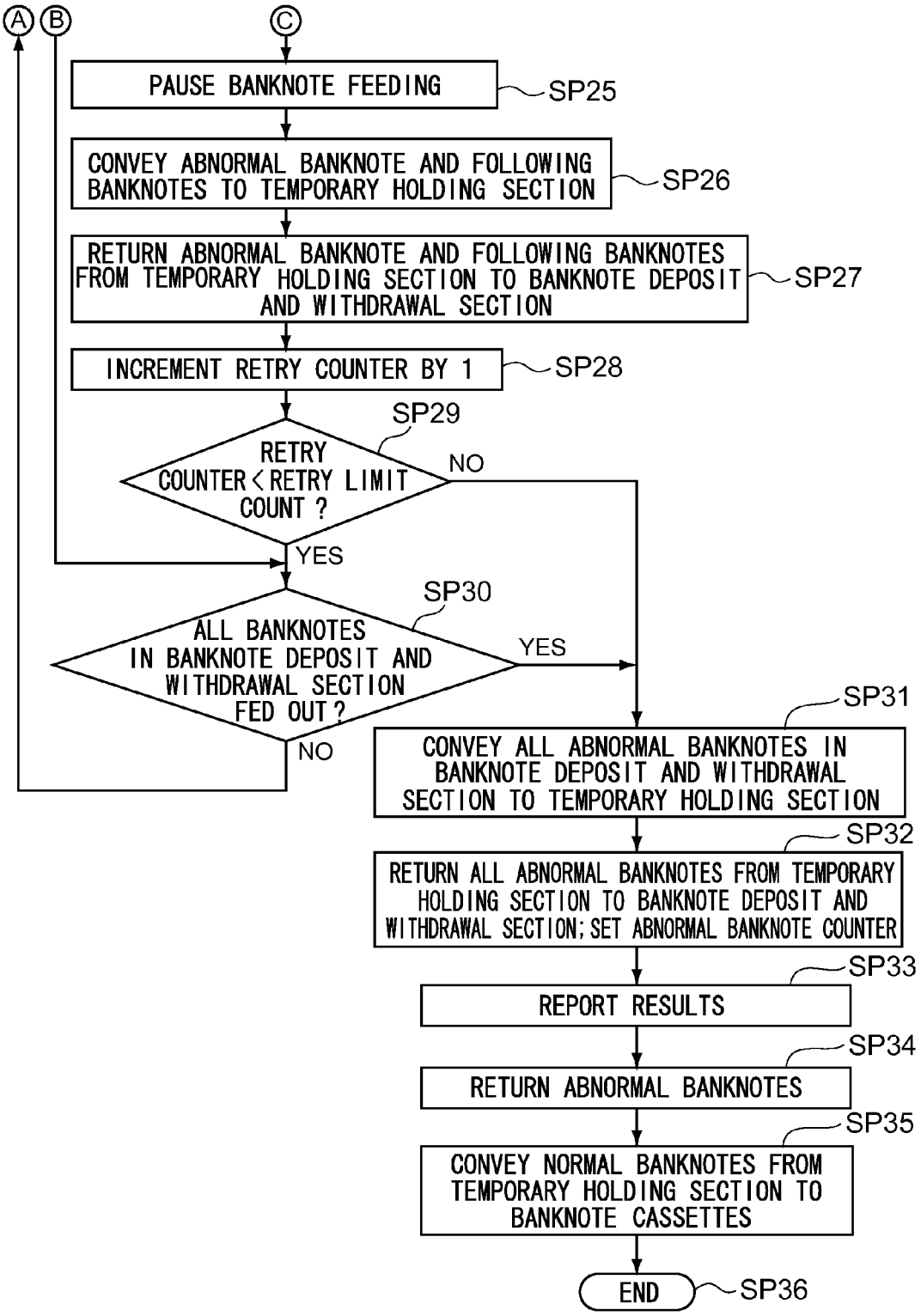
FIG. 10 is a flowchart showing the deposit processing routine in accordance with the second embodiment.

In step SP50, the control section 212 makes a determination as to whether the banknotes have been fed from the banknote deposit and withdrawal section 16 in a quantity corresponding to the abnormal banknote counter set in step SP32 (FIG. 10).

If a negative result is obtained in step SP50, this means that subsequent verification operations will continue to be carried out. In this case, the control section 212 returns to step SP42 and the feeding of banknotes from the banknote deposit and withdrawal section 16 continues.

On the other hand, if an affirmative result is obtained in step SP50, this indicates that, because all the banknotes have been fed out from the banknote deposit and withdrawal section 16, all of the abnormal banknotes stacked in the banknote deposit and withdrawal section 16 have gone through verification. In this case, the control section 212 proceeds to step SP51.

In step SP51, the control section 212 subtracts the normal banknote counter set in step SP45 from the abnormal banknote counter set in step SP32 (FIG. 10). Thus, the control section 212 calculates an intermittently separated abnormal banknotes number, which represents the number of abnormal banknotes when the verification processing is performed by intermittent separation. Then the control section 212 proceeds to step SP52.

From step SP52 to step SP55, the control section 212 carries out processing the same as from step SP15 to step SP18 of the deposit processing routine RT1 according to the first embodiment (FIG. 6), and ends the deposit processing routine RT3.

In step SP52, the control section 212 reports the numbers of normal banknotes and intermittently separated abnormal banknotes in the current deposit process to the customer. In step SP53, the control section 212 returns the intermittently separated abnormal banknotes that are stacked in the banknote deposit and withdrawal section 16 to the customer.

In step SP54, even for banknotes have been conveyed to the banknote deposit and withdrawal section 16 as abnormal banknotes in step SP32 of the deposit processing routine RT2 according to the second embodiment (FIG. 10), the control section 212 determines that banknotes that have subsequently been determined to be normal banknotes in step SP43 of the deposit processing routine RT3 and retained in the temporary holding section 20 are actually normal banknotes, and conveys these normal banknotes to the banknote cassettes 26.

—3-3. Operation and Effects—

The banknote deposit and withdrawal apparatus 210 with the structure described above performs verifications of the banknotes inserted at the banknote deposit and withdrawal section 16 with the verification section 18. The banknote deposit and withdrawal apparatus 210 conveys normal banknotes to the temporary holding section 20 and counts the number thereof. The banknote deposit and withdrawal apparatus 210 conveys abnormal banknotes, including following banknotes, to the banknote deposit and withdrawal section 16 via the temporary holding section 20 and stacks the abnormal banknotes in the banknote deposit and withdrawal section 16.

After the inserted banknotes have gone through verification, the banknote deposit and withdrawal apparatus 210 conveys the abnormal banknotes stacked in the banknote deposit and withdrawal section 16 through the temporary holding section 20 to the banknote deposit and withdrawal section 16, stacks these banknotes in the banknote deposit and withdrawal section 16, and counts the abnormal banknotes number.

While this verification operation is being performed, banknotes following the banknotes that have been verified as being abnormal banknotes are treated as abnormal banknotes and conveyed to the banknote deposit and withdrawal section 16. Therefore, even if the following banknotes are actually normal banknotes, these normal banknotes may be conveyed to the banknote deposit and withdrawal section 16 as abnormal banknotes.

However, the banknote deposit and withdrawal apparatus 210 conveys the abnormal banknotes stacked in the banknote deposit and withdrawal section 16, which may include normal banknotes, one at a time by intermittent separation, and performs verification operations thereon.

In the intermittent separation, there are no following banknotes in the conveyance section 24 between the verification section 18 and the banknote deposit and withdrawal section 16 when a banknote fed out from the banknote deposit and withdrawal section 16 is being verified by the verification section 18. Therefore, when an abnormal banknote is detected at the verification section 18, a return of following banknotes, which might have included a normal banknote, to the banknote deposit and withdrawal section 16 together with the abnormal banknote may be prevented.

Therefore, even when normal banknotes are included in banknotes that are stacked in the banknote deposit and withdrawal section 16 as a result of verification operations, these normal banknotes may be extracted from the abnormal banknotes. Therefore, the number of abnormal banknotes may be more accurately identified.

According to the structure described above, the banknote deposit and withdrawal apparatus 210 causes the control section 212 to function as a medium division and conveyance unit and an abnormal medium counting unit. The medium division and conveyance unit feeds out all banknotes from the banknote deposit and withdrawal section 16, which accommodates banknotes to be fed out and stacked banknotes without dividing therebetween, conveys the banknotes to the verification section 18, conveys abnormal banknotes that are verified as being abnormal at the verification section 18 to the banknote deposit and withdrawal section 16 together with following banknotes, but conveys normal banknotes that are verified as being normal by the verification section 18 to the temporary holding section 20 and retains the normal banknotes therein. The abnormal medium counting section feeds out all of the abnormal banknotes from the banknote deposit and withdrawal section 16 and conveys the abnormal banknotes to the temporary holding section 20, and then conveys the abnormal banknotes to the banknote deposit and withdrawal section 16 and counts the abnormal banknotes number, which is the total number of the abnormal banknotes.

The banknote deposit and withdrawal apparatus 210 also causes the control section 212 to function as an intermittently separated normal medium counting unit and an intermittently separated abnormal mediums number calculation unit. The intermittently separated normal medium counting unit feeds out the abnormal banknotes counted by the abnormal medium counting unit from the banknote deposit and withdrawal section 16 and conveys the abnormal banknotes to the verification section 18 in a quantity corresponding to the abnormal banknotes number, by intermittent separation in which a succeeding abnormal banknote is fed out after a preceding abnormal banknote has been verified by the verification section 18. The intermittently separated normal medium counting unit conveys intermittently separated abnormal banknotes that are verified as being abnormal at the verification section 18 to the banknote deposit and withdrawal section 16, but conveys intermittently separated normal banknotes that are verified as being normal by the verification section 18 to the temporary holding section 20 and retains the intermittently separated normal banknotes therein, and counts the intermittently separated normal banknotes number, which is the total number of the normal banknotes that have been intermittently separated. The intermittently separated abnormal mediums number calculation unit subtracts the intermittently separated normal banknotes number from the abnormal banknotes number to calculate an intermittently separated abnormal banknotes number.

Thus, even when banknotes to be fed out and stacked banknotes are accommodated without being divided in the banknote deposit and withdrawal section 16, the banknote deposit and withdrawal apparatus 210 may more accurately calculate the abnormal banknotes number.

4. Fourth Embodiment

—4-1. Structure of the Banknote Deposit and Withdrawal Apparatus—

As indicated in FIG. 1, an ATM 301 according to the fourth embodiment is structured similarly to the ATM 1 according to the first embodiment except in that a banknote deposit and withdrawal apparatus 310 differs from the banknote deposit and withdrawal apparatus 10.

As indicated in FIG. 3, the banknote deposit and withdrawal apparatus 310 has a similar structure to the banknote deposit and withdrawal apparatus 10 except in that a control section 312 differs from the control section 12.

—4-2. Deposit Processing—

When a customer is performing a deposit transaction to deposit banknotes, the control section 312 of the banknote deposit and withdrawal apparatus 310 receives a predetermined operation entry via the operation and display unit 6 and then opens the shutter 30 of the deposit and withdrawal aperture 5 to allow the insertion of banknotes into the banknote accommodation section 32.

Figure 16:
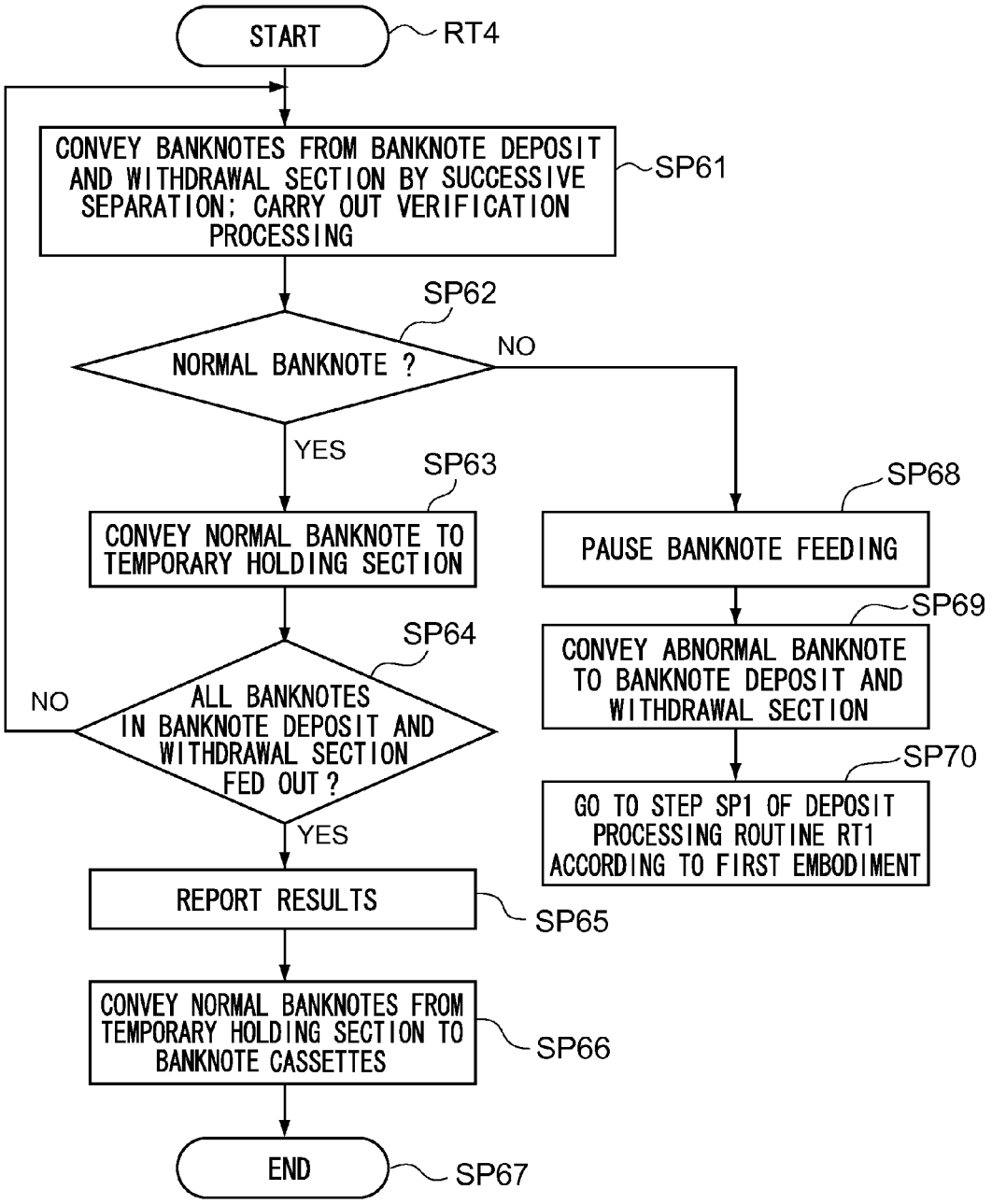
FIG. 16 is a flowchart showing a deposit processing routine in accordance with a fourth embodiment.

The control section 312 reads a deposit processing program from the memory section 14 and executes the deposit processing program. Thus, the control section 312 starts the deposit processing routine RT4 shown in FIG. 16 and proceeds to step SP61.

In step SP61, the control section 312 successively separates banknotes from the banknote deposit and withdrawal section 16 one at a time, hence conveying the banknotes to the verification section 18. By verification processing, the control section 312 makes a determination as to whether each banknote is a normal banknote or an abnormal banknote, and then proceeds to step SP62.

Figure 17:
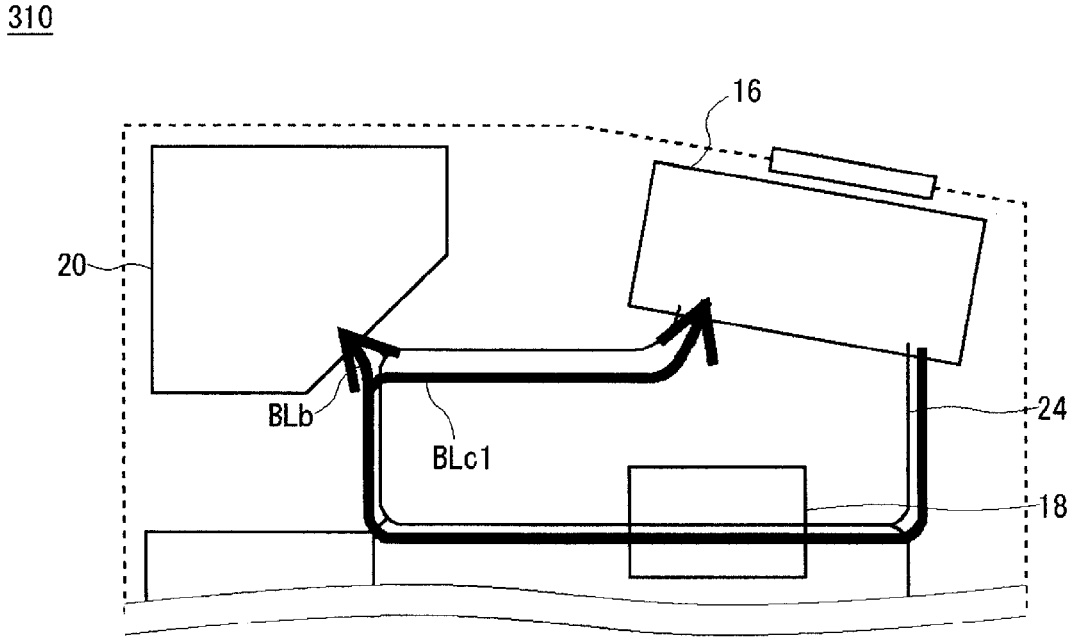
FIG. 17 is a schematic diagram showing paths of banknotes in accordance with the fourth embodiment.

In step SP62, when it is determined that a banknote is a normal banknote, the control section 312 proceeds to step SP63, conveys this normal banknote BLb from the verification section 18 to the temporary holding section 20 as shown in FIG. 17, and retains the normal banknote BLb in the temporary holding section 20. Then the control section 312 proceeds to step SP64.

In step SP64, on the basis of detection results reported from the banknote detection sensor at the banknote deposit and withdrawal section 16, the control section 312 makes a determination as to whether all of the banknotes in the banknote deposit and withdrawal section 16 have been fed out.

If a negative result is obtained in step SP64, this means that subsequent verification operations will continue to be carried out. In this case, the control section 312 returns to step SP61 and the feeding of banknotes from the banknote deposit and withdrawal section 16 continues.

On the other hand, if an affirmative result is obtained in step SP64, this means that all the banknotes have been fed out from the banknote deposit and withdrawal section 16 and all of the inserted banknotes are normal banknotes. Accordingly, the control section 312 proceeds to step SP65 and reports the number of normal banknotes in the current deposit process to the customer via the operation and display unit 6. Then, the control section 312 proceeds to step SP66, conveys the normal banknotes retained in the temporary holding section 20 to the banknote cassettes 26, and then proceeds to step SP67 and ends the deposit processing routine RT4.

On the other hand, if it is determined in step SP62 that a banknote is an abnormal banknote, the control section 412 proceeds to step SP68, pauses the feeding of banknotes from the banknote deposit and withdrawal section 16, and then proceeds to step SP69. The control section 412 switches the banknote deposit and withdrawal section 16 from the feed-out state to the stacking state and conveys abnormal banknotes BLc1 to the banknote deposit and withdrawal section 16 without conveying the same to the temporary holding section 20. The control section 412 then proceeds to step SP70, and goes to step SP1 of the deposit processing routine RT1 according to the first embodiment (FIG. 5).

—4-3. Operation and Effects—

The banknote deposit and withdrawal apparatus 310 with the structure described above performs verifications with the verification section 18 and conveys normal banknotes to the temporary holding section 20 until an abnormal banknote is detected.

when an initial (first) abnormal banknote BLc1 is detected, the banknote deposit and withdrawal apparatus 310 returns the abnormal banknote BLc1 to the banknote deposit and withdrawal section 16 and proceeds to the deposit processing routine RT1. In step SP2, of the inserted banknotes, the banknote deposit and withdrawal apparatus 310 counts the banknotes in the banknote deposit and withdrawal section 16 from which a number of normal banknotes have been removed before the detection of the initial abnormal banknote BLc1, and the banknote deposit and withdrawal apparatus 310 performs the subsequent processing.

Consequently, the inserted banknote counter that is set in step SP2 is a number that excludes the normal banknotes up to the initial detection of an abnormal banknote from the banknotes inserted in the banknote deposit and withdrawal section 16.

Thus, the banknote deposit and withdrawal apparatus 310 may reduce the number of banknotes that are counted when the total number of banknotes in the banknote deposit and withdrawal section 16 is counted, may reduce the number of normal banknotes that are counted when normal banknotes and abnormal banknotes are being verified in the subsequent processing, and may simplify the processing.

According to the structure described above, the banknote deposit and withdrawal apparatus 310 causes the control section 312 to function as a normal medium removal and conveyance unit, a fed-out medium counting unit, a normal medium counting unit, and an abnormal mediums number calculation unit. The normal medium removal and conveyance unit feeds out mediums from the banknote deposit and withdrawal section 16, which accommodates banknotes to be fed out and stacked banknotes without dividing therebetween, conveys the mediums to the verification section 18, conveys normal mediums that are verified as being normal by the verification section 18 to the temporary holding section 20 and retains the normal mediums therein, but conveys a banknote that is verified as being abnormal at the verification section 18 to the banknote deposit and withdrawal section 16 and pauses the feeding of mediums from the banknote deposit and withdrawal section 16. The fed-out medium counting unit counts a fed-out banknotes number, which is a total number of banknotes fed out from the banknote deposit and withdrawal section 16, by feeding out all banknotes from the banknote deposit and withdrawal section 16, from which normal banknotes have been removed from the inserted banknotes by the normal medium removal and conveyance unit, conveying the banknotes through the verification section 18 to the temporary holding section 20, and then conveying the banknotes to the banknote deposit and withdrawal section 16. The normal medium counting unit again feeds out and conveys the banknotes from the banknote deposit and withdrawal section 16 to the verification section 18 in a quantity corresponding to the fed-out banknotes number, conveys abnormal banknotes that are verified as being abnormal at the verification section 18 to the banknote deposit and withdrawal section 16 together with following banknotes, but conveys normal banknotes that are verified as being normal by the verification section 18 to the temporary holding section 20 and retains the normal banknotes therein, and counts the normal banknotes number, which is the total number of the normal banknotes. The abnormal mediums number calculation unit subtracts the normal banknotes number from the fed-out banknotes number to calculates the abnormal banknotes number, which is the number of the abnormal banknotes.

Thus, even when banknotes to be fed out and stacked banknotes are accommodated without being divided in the banknote deposit and withdrawal section 16, the banknote deposit and withdrawal apparatus 310 may make a duration of counting of the fed-out banknotes number before performing verification operations of the banknotes short, and may accurately calculate the abnormal mediums number in a short duration.

5. Fifth Embodiment

—5-1. Structure of the Banknote Deposit and Withdrawal Apparatus—

As indicated in FIG. 1, an ATM 401 according to the fifth embodiment is structured similarly to the ATM 1 according to the first embodiment except in that a banknote deposit and withdrawal apparatus 410 differs from the banknote deposit and withdrawal apparatus 10.

As indicated in FIG. 3, the banknote deposit and withdrawal apparatus 410 has a similar structure to the banknote deposit and withdrawal apparatus 10 except in that a control section 412 differs from the control section 12.

—5-2. Deposit Processing—

When a customer is performing a deposit transaction to deposit banknotes, the control section 412 of the banknote deposit and withdrawal apparatus 410 receives a predetermined operation entry via the operation and display unit 6 and then opens the shutter 30 of the deposit and withdrawal aperture 5 to allow the insertion of banknotes into the banknote accommodation section 32.

Figure 18:
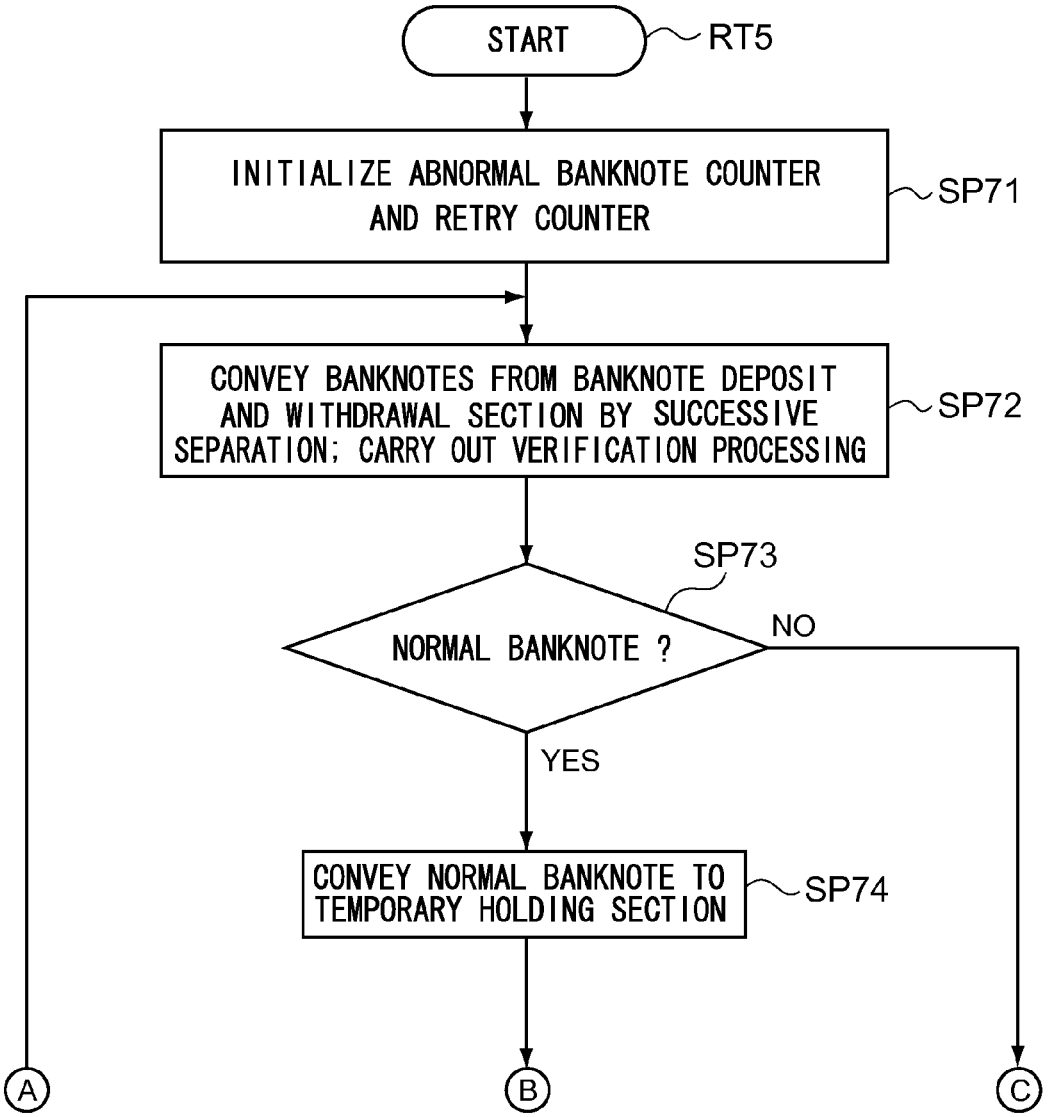
FIG. 18 is a flowchart showing a deposit processing routine in accordance with a fifth embodiment.
Figure 19:
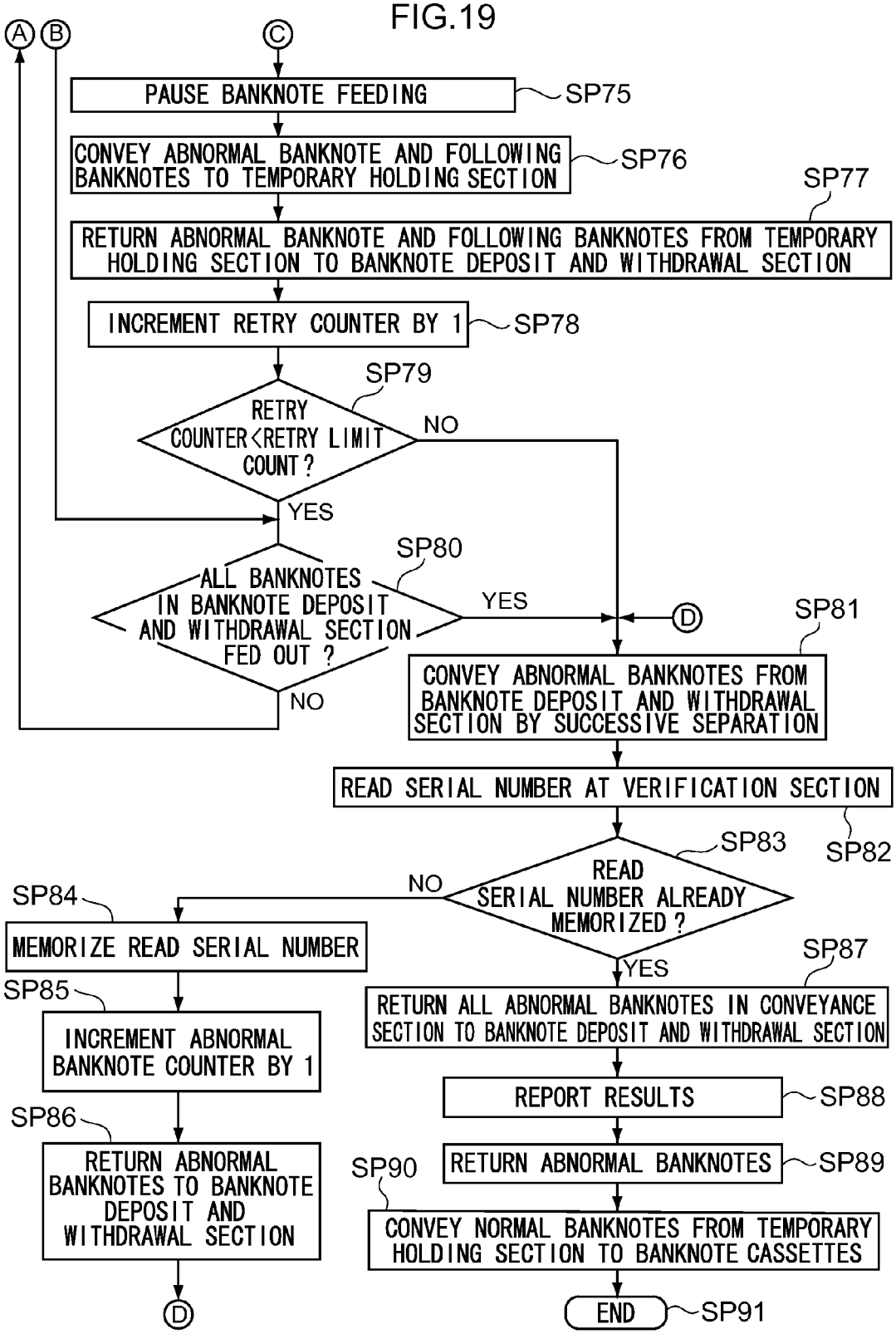
FIG. 19 is a flowchart showing the deposit processing routine in accordance with the fifth embodiment.
Figure 20:
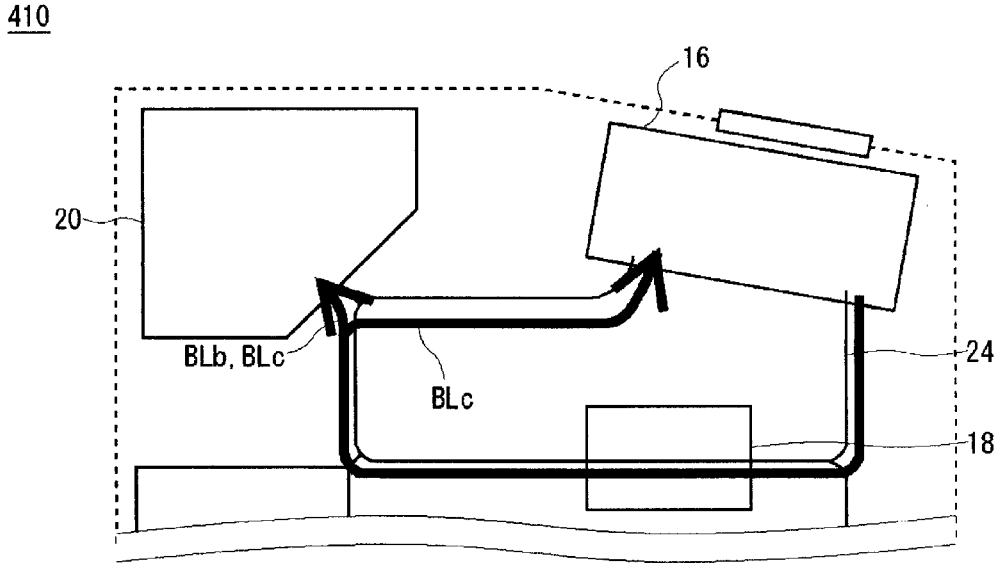
FIG. 20 is a schematic diagram showing paths of banknotes in accordance with the fifth embodiment.
Figure 21:
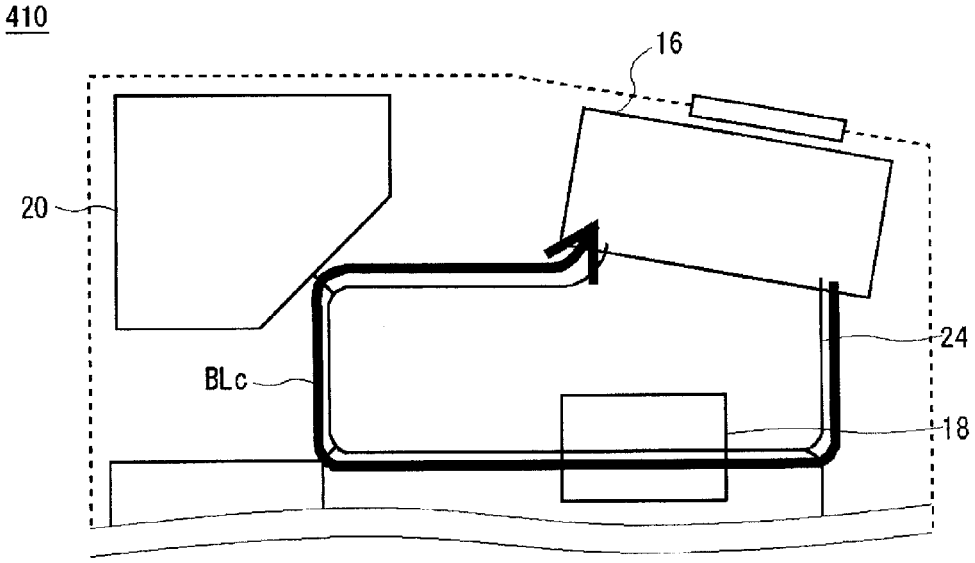
FIG. 21 is a schematic diagram showing paths of banknotes according to the fifth embodiment.

The control section 412 reads a deposit processing program from the memory section 14 and executes the deposit processing program. Thus, the control section 412 starts the deposit processing routine RT5 shown in FIG. 18 and FIG. 19 and proceeds to step SP71.

From step SP71 to step SP80, the control section 412 carries out processing the same as from step SP21 to step SP30 of the deposit processing routine RT2 according to the second embodiment (FIG. 9 and FIG. 10), and proceeds to step SP81.

In this state, the normal banknotes are retained at the temporary holding section 20 and the abnormal banknotes are stacked in the banknote deposit and withdrawal section 16. Accordingly, the control section 412 performs the processing described below to count the abnormal banknotes stacked in the banknote deposit and withdrawal section 16.

In step SP81, the control section 412 conveys, for example, three of the banknotes from the banknote deposit and withdrawal section 16 to the verification section 18 by successive separation, and then proceeds to step SP82.

In step SP82, the control section 412 reads a serial number printed on a banknote at the verification section 18, memorizes the serial number in the memory section 14, and then proceeds to step SP83 and makes a determination as to whether the serial number that is read has already been memorized in the memory section 14. Here, when the leading abnormal banknote of the three abnormal banknotes is passing through the verification section 18, the two following abnormal banknotes are in the conveyance section 24 between the verification section 18 and the banknote deposit and withdrawal section 16.

If a negative result is obtained in step SP83, this means that the read serial number has not already been memorized in the memory section 14 (that is, this banknote is passing through the verification section 18 for the first time since the start of counting of the abnormal banknotes number). In this case, the control section 412 proceeds to step SP84, adds the read serial number to the memory section 14 by memorization, and then proceeds to step SP85.

In step SP85, the control section 412 increments the abnormal banknote counter by 1 and then proceeds to step SP86. Thus, when the three abnormal banknotes have passed through the verification section 18, the abnormal banknote counter has been incremented by 3.

In step SP86, the control section 412 switches the banknote deposit and withdrawal section 16 from the feed-out state to the stacking state and conveys the three abnormal banknotes to the banknote deposit and withdrawal section 16 without passing through the temporary holding section 20. The control section 412 returns to step SP81 and goes on to feed out the next set of three abnormal banknotes from the banknote deposit and withdrawal section 16.

On the other hand, if an affirmative result is obtained in step SP83, this means that, because the read serial number has already been memorized in the memory section 14, all of the abnormal banknotes have gone through counting. In this case, the control section 412 proceeds to step SP87.

In step SP87, the control section 412 returns all three abnormal banknotes in the conveyance section 24, including the abnormal banknote with the serial number that is the same as a serial number that has already been memorized in the memory section 14, to the banknote deposit and withdrawal section 16 without passing through the temporary holding section 20.

In step SP88, the control section 412 reports the numbers of normal banknotes and abnormal banknotes (the value set for the abnormal banknote counter) in the current deposit process to the customer via the operation and display unit 6, and then proceeds to step SP89.

In step SP89, the control section 412 returns the abnormal banknotes that are stacked in the banknote deposit and withdrawal section 16 to the customer. In step SP90, the control section 412 conveys the normal banknotes that are retained in the temporary holding section 20 to the banknote cassettes 26. The control section 412 then proceeds to step SP91 and ends the deposit processing routine RT4.

—5-3. Operation and Effects—

The banknote deposit and withdrawal apparatus 410 with the structure described above performs verifications of the banknotes inserted at the banknote deposit and withdrawal section 16 with the verification section 18, conveys normal banknotes to the temporary holding section 20, and conveys abnormal banknotes to the banknote deposit and withdrawal section 16 via the temporary holding section 20 and stacks the abnormal banknotes in the banknote deposit and withdrawal section 16.

After the inserted banknotes have gone through verification, the banknote deposit and withdrawal apparatus 410 reads the serial numbers from the abnormal banknotes stacked in the banknote deposit and withdrawal section 16 with the verification section 18, returning the abnormal banknotes to the banknote deposit and withdrawal section 16 without passing through the temporary holding section 20.

If a banknote whose serial number has already been read (that is, a banknote that has already been counted as an abnormal banknote) is detected by the verification section 18, all the abnormal banknotes in the banknote deposit and withdrawal section 16 are considered to have been counted and the abnormal banknote counter is set as the abnormal banknotes number.

Thus, the banknote deposit and withdrawal apparatus 410 may confirm the number of abnormal banknotes without temporarily retaining the abnormal banknotes in the temporary holding section 20, just by the processing of reading serial numbers with the verification section 18.

According to the structure described above, the banknote deposit and withdrawal apparatus 410 causes the control section 412 to function as a medium division and conveyance unit that feeds out all banknotes from the banknote deposit and withdrawal section 16, which accommodates banknotes to be fed out and stacked banknotes without dividing therebetween, conveys the banknotes to the verification section 18, conveys abnormal banknotes that are verified as being abnormal at the verification section 18 to the banknote deposit and withdrawal section 16 together with following banknotes, but conveys normal banknotes that are verified as being normal by the verification section 18 to the temporary holding section 20 and retains the normal banknotes therein. The banknote deposit and withdrawal apparatus 410 causes the control section 412 and the verification section 18 to function as a serial number reading unit that repeatedly feeds out the abnormal banknotes from the banknote deposit and withdrawal section 16, reads serial numbers of the abnormal banknotes, and conveys the abnormal banknotes to the banknote deposit and withdrawal section 16. The banknote deposit and withdrawal apparatus 410 causes the control section 412 and the memory section 14 to function as a serial number memorization unit that memorizes the serial numbers read by the serial number reading unit. The banknote deposit and withdrawal apparatus 410 causes the control section 412 to function as an abnormal medium counting unit that counts up the abnormal mediums number, one at a time, each time the serial number of a banknote is read by the serial number reading unit, until a serial number that is the same as a serial number that has been memorized in the serial number memorization unit is read by the serial number reading unit.

Thus, even when banknotes to be fed out and stacked banknotes are accommodated without being divided in the banknote deposit and withdrawal section 16, the banknote deposit and withdrawal apparatus 410 may accurately calculate an abnormal banknotes number just by simple operations of performing verifications and counting up the abnormal banknotes number until a matching serial number is detected.

6. Alternative Embodiments

The present invention is not limited by the structure of the banknote deposit and withdrawal section 16 described above. That is, it is sufficient that banknotes to be separated and fed out and stacked banknotes are not separated in a banknote deposit and withdrawal section.

In the embodiments described above, it is described that the banknote deposit and withdrawal apparatus includes the banknote deposit and withdrawal section 16 that accommodates banknotes to be fed out and stacked banknotes without dividing therebetween, but the present invention is not limited thus. The present invention may be applied to a banknote deposit and withdrawal apparatus that includes a banknote deposit and withdrawal section that divides and accommodates banknotes to be fed out and stacked banknotes.

The deposit processes of the first to fifth embodiments described above may succeed one another and/or be combined as appropriate. For example, an abnormal banknotes number may be confirmed by carrying out the deposit processing routine RT1 after the deposit processing routine RT4, repeating the verification processing a plural number of times by successive separation, and thereafter performing verification processing by the intermittent separation of the deposit processing routine RT3. In this case, the abnormal banknotes number may be counted more accurately.

In the embodiments described above, cases are described in which the banknotes conveyed by the conveyance section 24 are counted on the basis of detection results from the verification section 18, the stacking aperture sensor and the retention section sensor.

The present invention is not limited thus. A sensor that detects banknotes at locations through which the banknotes pass during conveyance may be provided, and numbers of banknotes may be counted on the basis of detection results from this sensor.

In the fifth embodiment described above, a case is described in which it is determined that all abnormal banknotes in the banknote deposit and withdrawal section 16 have been fed out when a banknote on which a matching serial number is printed is detected.

The present invention is not limited thus. For example, a characteristic such as tearing, soiling or the like of each banknote may be read by the verification section 18, and it may be determined that all abnormal banknotes in the banknote deposit and withdrawal section 16 have been fed out when a banknote with a matching characteristic is detected.

In the present invention, the abnormal banknotes may be conveyed to and stored in the reject vault 28 rather than being returned to the customer.

Step SP3 of the deposit processing routine RT1 according to the first embodiment described above is not limited to the stacking aperture sensor; the inserted banknotes may be detected by the verification section 18 or the retention section sensor.

Step SP7 of the deposit processing routine RT1 according to the first embodiment described above is not limited to the retention section sensor; the normal banknotes may be detected by the verification section 18.

In step SP47 of the deposit processing routine RT3 according to the third embodiment described above, the abnormal banknotes may be conveyed to the banknote deposit and withdrawal section 16 via the temporary holding section 20.

In the deposit processing routine RT4 according to the fourth embodiment described above, the verification processing is carried out until a first abnormal banknote is detected, but the present invention is not limited thus. For example, the verification processing may be carried out until an arbitrary number of abnormal banknotes have been detected, such as a second abnormal banknote or the like.

In the deposit processing routine RT5 according to the fifth embodiment described above, the serial number of an abnormal banknote may be read and memorized in step SP72 and the determination as to whether the read serial number has already been memorized may be made in step SP83.

Step SP81 of the deposit processing routine RT5 according to the fifth embodiment described above is not limited to feeding out three notes at a time by successive separation; an arbitrary number of notes may be fed out at a time, such as, for example, one note, four notes or the like.

In step SP86 of the deposit processing routine RT5 according to the fifth embodiment described above, the abnormal banknotes may be conveyed to the banknote deposit and withdrawal section 16 via the temporary holding section 20.

In the deposit processes described above, when an abnormal banknote is detected by the verification section 18 and feeding of the banknotes is paused, banknote separation and return as recited in paragraph [0035] of JP-A No. 2000-152722 may be implemented at the banknote deposit and withdrawal section 16.

In step SP9 and step SP10 of the deposit processing routine RT1 described above, step SP26 and step SP27 of the deposit processing routine RT2, and step SP76 and step SP77 of the deposit processing routine RT5, the abnormal banknotes are temporarily conveyed to the temporary holding section 20 and then conveyed to the banknote deposit and withdrawal section 16.

The present invention is not limited thus. The abnormal banknotes in the conveyance section 24 may be stopped and conveyed to the banknote deposit and withdrawal section 16 without being conveyed to the temporary holding section 20, as in step SP47 of the deposit processing routine RT3.

In step SP2 and step SP3 of the deposit processing routine RT1 described above and in step SP31 and step SP32 of the deposit processing routine RT2, the number of banknotes inside the banknote deposit and withdrawal section 16 is counted by the banknotes being passed through the verification section 18 and the temporary holding section 20 and returned to the banknote deposit and withdrawal section 16.

The present invention is not limited thus. For example, a sensor that measures the thickness of a bundle of banknotes may be provided inside the banknote deposit and withdrawal section 16 and the number of banknotes calculated on the basis of thickness detection results from this sensor. Alternatively, a sensor that measures the weight of a bundle of banknotes may be provided inside the banknote deposit and withdrawal section 16 and the number of banknotes calculated on the basis of weight detection results from this sensor.

In the embodiments described above cases are described in which the deposit processing routine RT1 is executed by the control section 12, the deposit processing routine RT2 is executed by the control section 112, the deposit processing routine RT3 is executed by the control section 212, the deposit processing routine RT4 is executed by the control section 312, and the deposit processing routine RT5 is executed by the control section 412, respectively.

The present invention is not limited thus. For example, the deposit processing routine RT1, RT2, RT3, RT4 or RT5 may be executed by the main control section 9 or by cooperative operation of the main control section 9 and the control section 12, 116, 216, 316 or 416.

In the embodiments described above, cases are described in which a deposit processing program that has been memorized in the memory section 14 beforehand is read out and executed.

The present invention is not limited thus. For example, a deposit processing program may be read and executed from outside, via an interface such as USB (Universal Serial Bus) or the like, a network according to IEEE (Institute of Electrical and Electronics Engineers) 802.3ab or the like, or an external memory medium such as a CD-ROM (Compact Disc Read-Only Memory) or the like.

In the embodiments described above, cases are described in which mediums that are banknotes are conveyed inside the ATMs 1 to 401 that conduct transactions of cash, are verified by the verification section 18, and are conveyed to the temporary holding section 20 or the banknote deposit and withdrawal section 16.

The present invention is not limited thus and is applicable to various devices in which thin sheet-form mediums such as, for example, merchandise coupons, money certificates, event tickets or the like are conveyed, are verified by the verification section 18, and are conveyed to the temporary holding section 20 or the banknote deposit and withdrawal section 16.

The present invention is also applicable to automatic processing devices that are structured by combinations of plural types of device that perform various processes relating to transactions of banknotes and coins or the like, such as, for example, a banknote deposit and withdrawal apparatus in which banknotes are deposited and withdrawn and a sealed packet payment apparatus in which banknotes are sealed in blocks of a predetermined number, or the like.

In the embodiments described above, cases are described in which the present invention is applied to a device that carries out deposit transactions and withdrawal transactions. However, the present invention may be applied to a device that carries out only deposit transactions.

In the first embodiment described above, a case is described in which the banknote deposit and withdrawal apparatus 10 that serves as the medium processing device is structured by the banknote deposit and withdrawal section 16 serving as the medium accommodation section, the verification section 18 serving as the verification section, the temporary holding section 20 serving as the medium retention section, the control section 12 serving as the inserted medium counting unit, the control section 12 serving as the normal medium counting unit and the control section 12 serving as the abnormal mediums number calculation unit.

The present invention is not limited thus. A medium processing device may be structured by the medium accommodation section, the verification section, the medium retention section, the inserted medium counting unit, the normal medium counting unit and the abnormal mediums number calculation unit in alternative structures.

In the second embodiment described above, a case is described in which the banknote deposit and withdrawal apparatus 110 that serves as the medium processing device is structured by the banknote deposit and withdrawal section 16 serving as the medium accommodation section, the verification section 18 serving as the verification section, the temporary holding section 20 serving as the medium retention section, the control section 112 serving as the medium division and conveyance unit and the control section 112 serving as the abnormal medium counting unit.

The present invention is not limited thus. A medium processing device may be structured by the medium accommodation section, the verification section, the medium retention section, the medium division and conveyance unit and the abnormal medium counting unit in alternative structures.

In the fourth embodiment described above, a case is described in which the banknote deposit and withdrawal apparatus 310 that serves as the medium processing device is structured by the banknote deposit and withdrawal section 16 serving as the medium accommodation section, the verification section 18 serving as the verification section, the temporary holding section 20 serving as the medium retention section, the control section 312 serving as the normal medium removal and conveyance unit, the control section 312 serving as the medium separation and conveyance unit, and the control section 312 serving as the abnormal medium counting unit.

The present invention is not limited thus. A medium processing device may be structured by the medium accommodation section, the verification section, the medium retention section, the normal medium removal and conveyance unit, the medium separation and conveyance unit, and the abnormal medium counting unit in alternative structures.

In the fifth embodiment described above, a case is described in which the banknote deposit and withdrawal apparatus 410 that serves as the medium processing device is structured by the banknote deposit and withdrawal section 16 serving as the medium accommodation section, the verification section 18 serving as the verification section, the temporary holding section 20 serving as the medium retention section, the control section 412 serving as the medium division and conveyance unit, the control section 412 and the verification section 18 serving as the serial number reading unit, the control section 412 and the memory section 14 serving as the serial number memorization unit, and the control section 412 serving as the abnormal medium counting unit.

The present invention is not limited thus. A medium processing device may be structured by the medium accommodation section, the verification section, the medium retention section, the medium division and conveyance unit, the serial number reading unit, the serial number memorization unit, and the abnormal medium counting unit in alternative structures.

INDUSTRIAL APPLICABILITY

The present invention may be applied to various devices that differentiate between normal mediums and abnormal mediums.

The disclosures of Japanese Patent Application No. 2013-026429 filed Feb. 14, 2013 are incorporated into the present specification by reference in their entirety.

The invention claimed is:

1. A medium processing device comprising:

a medium accommodation section that separates an accommodated plurality of paper-form mediums one at a time and feeds out the mediums to a conveyance section, and that stacks the mediums that are conveyed from the conveyance section;

a verification section that is provided on the conveyance path and verifies whether the mediums are normal or abnormal;

a medium retention section that is provided on the conveyance path and temporarily retains the mediums;

an inserted medium counting unit that feeds out all of the mediums from the medium accommodation section, counts an inserted mediums number, which is a total number of the mediums, and conveys the mediums to the medium accommodation section;

a normal medium counting unit that again feeds out the mediums from the medium accommodation section and conveys the mediums to the verification section, conveys normal mediums that are verified as being normal by the verification section to the medium retention section for retaining the mediums thereat, and counts a normal mediums number, which is a total number of the normal mediums; and an abnormal mediums number calculation unit that subtracts the normal mediums number from the inserted mediums number and calculates an abnormal mediums number, which is a number of the abnormal mediums.

2. A medium processing device according to claim 1, wherein the medium accommodation section accommodates the mediums that are to be fed out and the mediums that are stacked without dividing therebetween.

3. A medium processing device comprising:

a medium accommodation section that separates an accommodated plurality of paper-form mediums one at a time and feeds out the mediums to a conveyance section, and that stacks the mediums that are conveyed from the conveyance section;

a verification section that is provided on the conveyance path and verifies whether the mediums are normal or abnormal;

a medium retention section that is provided on the conveyance path and temporarily retains the mediums;

a medium division and conveyance unit that feeds out all of the mediums from the medium accommodation section and conveys the mediums to the verification section, and conveys abnormal mediums that are verified as being abnormal at the verification section to the medium accommodation section; and an abnormal medium counting unit that feeds out all of the abnormal mediums from the medium accommodation section, counts an abnormal mediums number, which is a total number of the abnormal mediums, and conveys the abnormal mediums to the medium accommodation section.

4. The medium processing device according to claim 3, further comprising:

an intermittently separated normal medium counting unit that feeds out the abnormal mediums counted by the abnormal medium counting unit from the medium accommodation section and conveys the abnormal mediums to the verification section in a quantity corresponding to the abnormal mediums number, by intermittent separation in which a succeeding abnormal medium is fed out after a preceding abnormal medium has been verified by the verification section, conveys intermittently separated normal mediums that are verified as being normal by the verification section to the medium retention section for retaining the intermittently separated normal mediums thereat, and counts an intermittently separated normal mediums number, which is a total number of the intermittently separated normal mediums; and an intermittently separated abnormal mediums number calculation unit that subtracts the intermittently separated normal mediums number from the abnormal mediums number and calculates an intermittently separated abnormal mediums number, which is a number of the abnormal mediums.

5. A medium processing device according to claim 3, wherein the medium accommodation section accommodates the mediums that are to be fed out and the mediums that are stacked without dividing therebetween.

6. A medium processing device comprising:

a medium accommodation section that separates an accommodated plurality of paper-form mediums one at a time and feeds out the mediums to a conveyance section, and that stacks the mediums that are conveyed from the conveyance section;

a verification section that is provided on the conveyance path and verifies whether the mediums are normal or abnormal;

a medium retention section that is provided on the conveyance path and temporarily retains the mediums;

a normal medium removal and conveyance unit that feeds out the mediums from the medium accommodation section and conveys the mediums to the verification section, conveys normal mediums that are verified as being normal by the verification section to the medium retention section for retaining the normal mediums thereat, and conveys a medium that is verified as being abnormal at the verification section to the medium accommodation section and pauses the feeding of the mediums from the medium accommodation section;

a fed-out medium counting unit that feeds out all of the mediums, from which the normal mediums have been removed by the normal medium removal and conveyance unit, from the medium accommodation section, counts a fed-out mediums number, which is a total number of the mediums fed out from the medium accommodation section, and conveys the mediums to the medium accommodation section;

a normal medium counting unit that again feeds out the mediums from the medium accommodation section in a quantity corresponding to the fed-out mediums number and conveys the mediums to the verification section, conveys normal mediums that are verified as being normal by the verification section to the medium retention section for retaining the normal mediums thereat, and counts a normal mediums number, which is a total number of the normal mediums; and an abnormal mediums number calculation unit that subtracts the normal mediums number from the fed-out mediums number and calculates an abnormal mediums number, which is a number of the abnormal mediums.

7. The medium processing device according to claim 6, further comprising:

an intermittently separated normal medium counting unit that feeds out the abnormal mediums counted by the abnormal medium calculation unit from the medium accommodation section and conveys the abnormal mediums to the verification section in a quantity corresponding to the abnormal mediums number, by intermittent separation in which a succeeding abnormal medium is fed out after a preceding abnormal medium has been verified by the verification section, conveys intermittently separated normal mediums that are verified as being normal by the verification section to the medium retention section for retaining the intermittently separated normal mediums thereat, and counts an intermittently separated normal mediums number, which is a total number of the intermittently separated normal mediums; and an intermittently separated abnormal mediums number calculation unit that subtracts the intermittently separated normal mediums number from the abnormal mediums number and calculates an intermittently separated abnormal mediums number, which is a number of the abnormal mediums.

8. A medium processing device according to claim 6, wherein the medium accommodation section accommodates the mediums that are to be fed out and the mediums that are stacked without dividing therebetween.

9. A medium processing device comprising:

a medium accommodation section that separates an accommodated plurality of paper-form mediums one at a time and feeds out the mediums to a conveyance section, and that stacks the mediums that are conveyed from the conveyance section;

a verification section that is provided on the conveyance path and verifies whether the mediums are normal or abnormal;

a medium retention section that is provided on the conveyance path and temporarily retains the mediums;

a medium division and conveyance unit that feeds out all of the mediums from the medium accommodation section and conveys the mediums to the verification section, and conveys abnormal mediums that are verified as being abnormal at the verification section to the medium accommodation section;

a serial number reading unit that feeds out the abnormal mediums from the medium accommodation section, reads serial numbers of the abnormal mediums, and conveys the abnormal mediums to the medium accommodation section;

a serial number memorization unit that memorizes the serial numbers read by the serial number reading unit; and an abnormal medium counting unit that counts a number of the abnormal mediums fed out from the medium accommodation section, until a serial number that is the same as a serial number that has been memorized in the serial number memorization unit is read by the serial number reading unit.

10. A medium processing device according to claim 9, wherein the medium accommodation section accommodates the mediums that are to be fed out and the mediums that are stacked without dividing therebetween.

* * * * *